US010879579B2

(12) United States Patent
Zhang et al.

(10) Patent No.: US 10,879,579 B2
(45) Date of Patent: Dec. 29, 2020

(54) ZERO INSERTION LOSS DIRECTIONAL COUPLER FOR WIRELESS TRANSCEIVERS WITH INTEGRATED POWER AMPLIFIERS

(71) Applicant: Skyworks Solutions, Inc., Woburn, MA (US)

(72) Inventors: Lisette L. Zhang, Irvine, CA (US); Oleksandr Gorbachov, Irvine, CA (US)

(73) Assignee: SKYWORKS SOLUTIONS, INC., Irvine, CA (US)

( * ) Notice: Subject to any disclaimer, the term of this patent is extended or adjusted under 35 U.S.C. 154(b) by 0 days.

(21) Appl. No.: 16/432,416

(22) Filed: Jun. 5, 2019

(65) Prior Publication Data

US 2019/0312328 A1 Oct. 10, 2019

Related U.S. Application Data

(63) Continuation of application No. 15/905,116, filed on Feb. 26, 2018, now Pat. No. 10,340,576, which is a continuation of application No. 14/805,383, filed on Jul. 21, 2015, now Pat. No. 9,905,902.

(60) Provisional application No. 62/028,396, filed on Jul. 24, 2014.

(51) Int. Cl.
*H01P 5/18* (2006.01)

(52) U.S. Cl.
CPC ..... *H01P 5/184* (2013.01)

(58) Field of Classification Search
CPC ..... H01P 5/18; H01P 5/184
USPC ..... 333/109–112, 116
See application file for complete search history.

(56) References Cited

U.S. PATENT DOCUMENTS

| | | | |
|---|---|---|---|
| 5,159,298 | A | 10/1992 | Dydyk |
| 6,342,681 | B1 | 1/2002 | Goldberger et al. |
| 6,686,812 | B2 | 2/2004 | Gilbert et al. |
| 6,771,141 | B2 | 8/2004 | Iida et al. |
| 7,305,223 | B2 | 12/2007 | Liu et al. |
| 7,446,626 | B2 | 11/2008 | Gorbachov |
| 7,504,907 | B2 | 3/2009 | Fujiki et al. |
| 7,869,784 | B2 | 1/2011 | Liu |
| 8,148,793 | B2 | 4/2012 | Liu |
| 8,294,632 | B2 | 10/2012 | Skarp |
| 8,928,428 | B2 | 1/2015 | Gorbachov |
| 9,093,734 | B2 | 7/2015 | Gorbachov |
| 9,379,678 | B2 | 6/2016 | Kase et al. |
| 9,905,902 | B2 | 2/2018 | Zhang et al. |
| 2013/0207741 | A1 | 8/2013 | Presti |
| 2017/0373767 | A1 | 12/2017 | Wu et al. |

*Primary Examiner* — Dean O Takaoka
(74) *Attorney, Agent, or Firm* — Lando & Anastasi, LLP

(57) ABSTRACT

A zero insertion loss directional coupler includes an input port, an antenna port, an isolation port, and a detect port. The coupler has a first signal trace, a second signal trace, and an inductive winding. The first signal trace is on one of two layers and is connected to the input port and the antenna port, while the inductive winding is on another one of the two layers. A first terminal of the inductive winding is connected to the isolation port. A first terminal of the second signal trace is connected to the detect port and a second terminal of the second signal trace is connected to a second terminal of the inductive winding.

20 Claims, 39 Drawing Sheets

ZERO INSERTION LOSS DIRECTIONAL COUPLER FOR WIRELESS TRANSCEIVERS WITH INTEGRATED POWER AMPLIFIERS

CROSS-REFERENCE TO RELATED APPLICATIONS

This application is a continuation patent application of co-pending U.S. patent application Ser. No. 15/905,116 filed Feb. 26, 2018 and entitled "ZERO INSERTION LOSS DIRECTIONAL COUPLER FOR WIRELESS TRANSCEIVERS WITH INTEGRATED POWER AMPLIFIERS," which is a continuation patent application of U.S. patent application Ser. No. 14/805,383 filed Jul. 1, 2015 and entitled "ZERO INSERTION LOSS DIRECTIONAL COUPLER FOR WIRELESS TRANSCEIVERS WITH INTEGRATED POWER AMPLIFIERS, which relates to and claims the benefit of U.S. Provisional Application No. 62/028,396 filed Jul. 24, 2014 and entitled ZERO INSERTION LOSS DIRECTIONAL COUPLER FOR WIRELESS TRANSCEIVERS WITH INTEGRATED POWER AMPLIFIERS, the disclosures of which are wholly incorporated by reference in their entirety herein.

STATEMENT RE: FEDERALLY SPONSORED RESEARCH/DEVELOPMENT

Not Applicable

BACKGROUND

1. Technical Field

The present disclosure relates to Radio Frequency (RF) circuit components, and more particularly, to a zero insertion loss directional coupler for wireless transceivers with integrated power amplifiers.

2. Related Art

Generally, wireless communications involve a radio frequency (RF) carrier signal that is variously modulated to represent data, and the modulation, transmission, receipt, and demodulation of the signal conform to a set of standards for coordination of the same. Many different mobile communication technologies or air interfaces exist, including GSM (Global System for Mobile Communications), EDGE (Enhanced Data rates for GSM Evolution), and UMTS (Universal Mobile Telecommunications System). More recently, 4G (fourth generation) technologies such as LTE (Long Term Evolution), which is based on the earlier GSM and UMTS standards, are being deployed. Besides mobile communications modalities such as these, various communications devices incorporate local area data networking modalities such as Wireless LAN (WLAN)/WiFi, ZigBee, and so forth.

A fundamental component of any wireless communications system is the transceiver, that is, the combined transmitter and receiver circuitry. The transceiver encodes the data to a baseband signal and modulates it with an RF carrier signal. Upon receipt, the transceiver down-converts the RF signal, demodulates the baseband signal, and decodes the data represented by the baseband signal. An antenna connected to the transmitter converts the electrical signals to electromagnetic waves, and an antenna connected to the receiver converts the electromagnetic waves back to electrical signals. Depending on the particulars of the communications modality, single or multiple antennas may be utilized. The transmitter typically includes a power amplifier, which amplifies the RF signals prior to transmission via an antenna. The receiver is typically coupled to an antenna and includes a low noise amplifier, which receives inbound RF signals via the antenna and amplifies them.

The power amplifier is a key building block in all RF transmitter circuits. To lower the cost and allow full integration of a complete multi-mode multi-band radio frequency System-on-Chip (RF-SoC), integrating the power amplifier with the transceiver circuit is common. Because of advances in nanometer technology, and ever increasing device unity power gain frequency $f_{max}$, Radio Frequency Complementary Metal-oxide Semiconductor (RF-CMOS) has become a viable low-cost option for implementing highly integrated Radio Frequency Integrated Circuit (RFIC) products or applications, such as the aforementioned WiFi and 3G/4G LTE applications, as well as point-to-point radio, 60 GHz band Wireless Gigabit Alliance (WiGig), and automotive radar RF-SoC applications. There are challenges associated with the design and fabrication of the power amplifier with a CMOS process, due to high output linear power and corresponding efficiency parameters, along with an extremely low error vector magnitude (EVM) floor requirement. It is understood that the higher the output power, the lower the optimal drain impedance. Thus, resistive loss at the output matching network becomes more significant. Along these lines, shrinking die sizes and the concomitant use of wafer-level chip scale packaging (WLCSP), wafer level ball grid array (WLBGA), and the like have also represented design challenges of RF-SoC devices.

Detecting and controlling the performance of a power amplifier makes it possible to maximize the output power while achieving optimum linearity and efficiency. One conventional technique involves the use of a capacitor to tap a fraction of the output power and feeding the same to a power detector circuit. The performance is highly variable as dependent on the frequency of the signal, temperature, and antenna voltage standing wave ratio (VSWR). Furthermore, without an isolation port, existing techniques involving the application of a complex impedance termination to offset a non-ideal RF port reflection coefficient and non-ideal coupler directivity for minimizing output power variation under VSWR would not be possible. Moreover, accurate power control with a mismatched load in the transmit chain with over 40 dB of dynamic range is also understood to be challenging. Another conventional technique is the use of an edge-coupled transformer at the output of the RF signal chain. Two terminals of the transformer are connected to the main signal path, with the third terminal serving as a detector port, and a fourth terminal serving as an isolation port.

Directional couplers, which are passive devices utilized to couple a part of the transmission power on one signal path to another signal path by a predefined amount, may also be used in multiple wireless systems for such power detection and control. Conventionally, this is achieved by placing the two signal paths in close physical proximity to each other, such that the energy passing through one is passed to the other. This property is useful for a number of different applications, including power monitoring and control, testing and measurements, and so forth.

A conventional directional coupler is a four-port device including an input port (P1), an output port (P2), an isolation port (P3), and a coupled port (P4). The power supplied to the input port P1 is coupled to the coupled port P4 according to a coupling factor that corresponds to the fraction of the input power that is passed to the coupled port P4. The remainder of the power on the input port P1 is delivered to the antenna port P2, and in an ideal case, no power is delivered to the isolation port P3. In actual implementation, however, some level of the signal is passed to both to the isolation port P3 and the coupled port P4, though the addition of an isolating resistor to the isolation P3 may dissipate some of this power. The insertion loss associated with the circuitry between the output of the power amplifier and the antenna, a substantial portion of which is attributable to the directional coupler, represents another challenge in RF-SoC designs.

Various solutions to reduce signal loss in directional couplers have been proposed. One solution disclosed in U.S. Pat. No. 7,446,626 is understood to be directed to coupled inductors with low inductance values. However, the lumped element capacitors utilized therein may be limited, and capable of sustaining a limited voltage level. Another proposal is disclosed in U.S. Pat. No. 8,928,428, where compensation capacitors allow for high voltage operation. Further improvements to directional couplers are disclosed in a pending and commonly owned U.S. patent application Ser. No. 14/251,197 entitled MINIATURE RADIO FREQUENCY DIRECTIONAL COUPLER FOR CELLULAR APPLICATIONS filed on Apr. 11, 2014, the entirety of the disclosure of which is hereby incorporated by reference. Two chains of inductors and two or more compensation capacitors can be used, allowing for high power levels partially because of higher breakdown voltages of the constituent components. Insertion loss may also be minimized because of the small values of the coupled inductors and the reduced loss from the compensation capacitors. However, it would be desirable for insertion loss to be further reduced to a near-zero level.

Accordingly, there is a need in the art for improved directional couplers capable of high operating voltages, zero insertion loss and a miniaturized size for wireless transceivers with integrated power amplifiers.

BRIEF SUMMARY

A zero insertion loss directional coupler is disclosed, and is understood to have a variety of geometry shapes, sizes, and winding structures with small variations in the detected port power output over a range of signal frequencies and antenna voltage standing wave ratios. Furthermore, the disclosed directional coupler is understood to have no additional footprint because it is disposed under other circuit components such as inductors, connection pads, and RF signal traces. While a bulk CMOS process is contemplated for fabrication, the disclosed directional coupler need not be limited thereto, and other semiconductor processes such as CMOS silicon-on-insulator, silicon germanium (SiGe) heterojunction bipolar transistor (HBT), gallium arsenide (GaAs) and so on may be substituted.

In a first embodiment of the zero insertion loss directional coupler, there is an input port, an antenna port, an isolation port, and a detect port. The coupler may further include two conductive layers, a first signal trace, and an inductive winding. The first signal trace may be on one layer and connected to the input port and the antenna port. The inductive winding with two terminals may be on another layer. The first terminal of the inductive winding may be connected to the isolation port. The coupler may further include a second signal trace with two terminals. The first terminal of the second signal trace may be connected to the detect port and the second terminal of the second signal trace may be connected to the second terminal of the inductive winding. The inductive winding may have at least one turn. The first signal trace may comprise a first section with a first predefined width, and a second section with a second predefined width. The first signal trace may partially overlap or route over the inductive winding. The coupling factor between the first signal trace and the inductive winding can correspond to the number of the inductive winding turns, and/or to the overlapped area between the first signal trace and the inductive winding, and/or to the intermediate space distance of the two conductive layers.

A second embodiment of the zero insertion loss directional coupler for connecting between an output of a power amplifier and an antenna may include an input port, an antenna port, an isolation port, a detect port, two transmission lines, a single turn inductor and a harmonic blocking inductor. The coupler may have two conductive layers. One layer may include the single turn inductor with two terminals. The first terminal of the single turn inductor may be connected to the input port and the second terminal of the single turn inductor may be connected to the antenna port. The other layer may include the harmonic blocking inductor with two terminals. The first transmission line may have two terminals. The first terminal of the first transmission line may be connected to the isolation port, while the second transmission line may have two terminals. The first terminal of the second transmission line may be connected to the detect port. The first terminal of the harmonic blocking inductor may be connected to the second terminal of the first transmission line and the second terminal of the harmonic blocking inductor may be connected to the second terminal of the second transmission line. The first transmission line may partially axially surrounds the single turn inductor, and the second transmission line may partially axially surrounds the single turn inductor. The coupler may further include a capacitor connected to the input port and the antenna port.

A third embodiment of the zero insertion loss directional coupler may include an input port, an antenna port, an isolation port, and a detect port. The coupler may also include two conductive layers, with a single turn inductor on one layer, and an inductive winding on another layer. The single turn inductor may be connected to the input port and the antenna port. The inductive winding may have two terminals. The first terminal of the inductive winding may be connected to the isolation port. The coupler may further include a signal trace with two terminals. The first terminal of the signal trace may be connected to the detect port, and the second terminal of the signal trace may be connected to the second terminal of the inductive winding.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiments of a directional coupler capable of high operating voltages, have zero or near-zero insertion loss, and with minimal footprints. Additional advantageous characteristics are contemplated, with varying geometries and winding structures. It is not intended to represent the only form in which the present invention may be developed or utilized, and the same or equivalent functions may be accomplished by different embodiments that are also intended to be encompassed within the scope of the invention. It is further understood that the use of relational terms such as first and second and the like are used solely to distinguish one from another entity without necessarily requiring or implying any actual such relationship or order between such entities.

Figure 1:
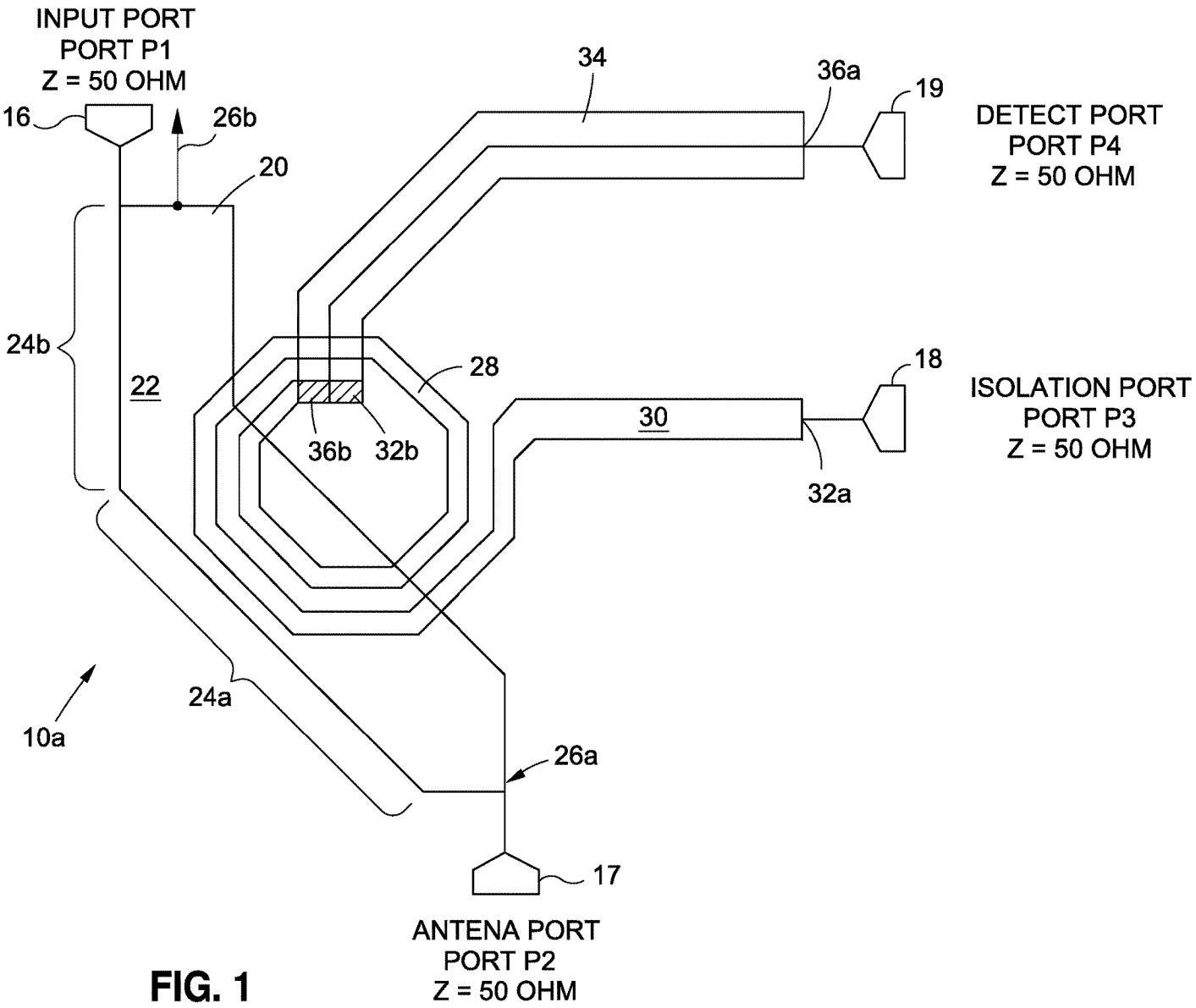
FIG. 1 is a top plan view of a first embodiment of a zero insertion loss directional coupler.

With reference to the plan view of FIG. 1, first embodiment of a directional coupler 10*a* includes an input port 16, an antenna port 17, an isolation port 18, and a detect port 19. In accordance with a typical application, a radio frequency (RF) transmission signal is amplified by a power amplifier circuit, the output of which is connected to the input port 16. In a typical power amplifier circuit, the final segment is an output matching network, and so the input port 16 of the directional coupler 10*a* is understood to be connected thereto. Most of the RF signal is passed to the antenna port 17, though a portion is ultimately passed to the detect port 19. In an ideal case, the signal is not passed to the isolation port 18, but in a typical implementation, at least a minimal signal level is present thereon. For purposes of discussing and graphically illustrating the scattering parameters (S-parameters) of the four-port device that is the directional coupler 10*a*, the input port 16 may be referred to as port P1, the antenna port 17 may be referred to as port P2, the isolation port 18 may be referred to as port P3, and the detect port 19 may be referred to as port P4. Each of the ports is understood to have a characteristic impedance of 50 Ohm for standard matching of components.

Different parts of the directional coupler 10 are fabricated on multiple, overlapping conductive layers in accordance with various embodiments. More particularly, the first embodiment of the direction coupler 10*a* is comprised of a first signal trace 20 that is disposed on a first conductive layer 22. The first signal trace 20 is defined by a first section 24*a* with a predefined width and length, as well as a second section 24*b* with a predefined width and length. The first section 24*a* may be angled relative to the second section 24*b* as shown, and the extent of the angular offset may be varied without departing from the present disclosure. The predefined width of the first section 24*a* and the predefined width of the second section 24*b* may be same, or may be different. By way of example only and not of limitation, the predefined width of the first section 24*a* is approximately 18 μm and the predefined width of the second section 24*b* is 15 μm. Furthermore, the thickness of the first signal trace 20 is approximately 4 μm.

The first signal trace 20 has two terminals 26*a*, 26*b*. One terminal 26*a* corresponds to an end of the first section 24*a* that is connected to or is integral with the antenna port 17 (P2). The other terminal 26*b* correspond to an end of the second section 24*b* of the first signal trace 20 that is connected to or is integral with the input port 16*a* (P1).

The first embodiment of the directional coupler 10*a* further includes an inductive winding 28 that is disposed on a second conductive layer 30 that is spaced apart from the first conductive layer 22. The coupling factor between the first signal trace 20 and the inductive winding 28 is understood to correspond to an intermediate space distance between the two layers, with an exemplary embodiment defining a space of approximately 0.95 μm. It is understood that the closer the spacing, the higher the coupling level. Depending on the viewpoint, the first conductive layer 22 may be above the second conductive layer 30, or vice versa; it is expressly contemplated that the directional coupler 10*a* need not be limited to a particular orientation, so the use of relative terms to describe the positioning of the first conductive layer 22 and the second conductive layer 30 is not intended to be limiting, and only for convenience purposes. The first conductive layer 22 may be in a substantially parallel relationship to the second conductive layer 30. It is understood that these layers are on a single integrated circuit die.

As illustrated in FIG. 1, the inductive winding 28 has at least one turn that is in a spiral configuration, though as in the depicted embodiment, it may have multiple turns. The coupling factor between the first signal trace 20 and the inductive winding 28 is understood to correspond to the number of turns of the inductive winding 28, and the greater the number of turns, the higher the coupling factor. In typical directional coupler configuration based on coupled transmission lines, both lines (signal and coupled) may be longer to increase the coupling factor. In such configurations, the insertion loss in the signal line is understood to be higher commensurate with the higher coupling factor. In further detail, the inductive winding 28 at least partially overlaps the first signal trace 20, and the coupling factor is also understood to correspond to the overlapping area, with a greater area of overlap, the higher the coupling factor. The inductive winding 28 has two terminals 32*a*, 32*b*. The first terminal 32*a* is connected to or integral with the isolation port 18 (P3), and the second terminal 32*b* is connected to the detect port 19, as will be described in further detail below. By way of example only and not of limitation, the overall dimensions of the inductive winding 28 are approximately 40 μm×36 μm. Additionally, by way of example, the width of the conductive trace of the inductive winding 28 is approximately 2.63 μm, and its thickness is approximately 0.56 μm. The space distance between individual turns of the inductive winding 28 may be approximately 3 μm.

The first embodiment of the directional coupler 10*a* further includes a second signal trace 34 with two terminals 36. The first terminal 36*a* of the second signal trace 24 is connected to the detect port 19 (P4). The second terminal 36*ba* is connected to the second terminal 32*b* of the inductive winding 28. As shown, this connection point of the inductive winding 28 and the second signal trace 24 is disposed with an interior part of the spiral winding. Accordingly, to route the second signal trace 34 outside the spiral, it may be disposed on a different conductive layer with a spatial overlap above/below the inductive winding 28.

Figure 2:
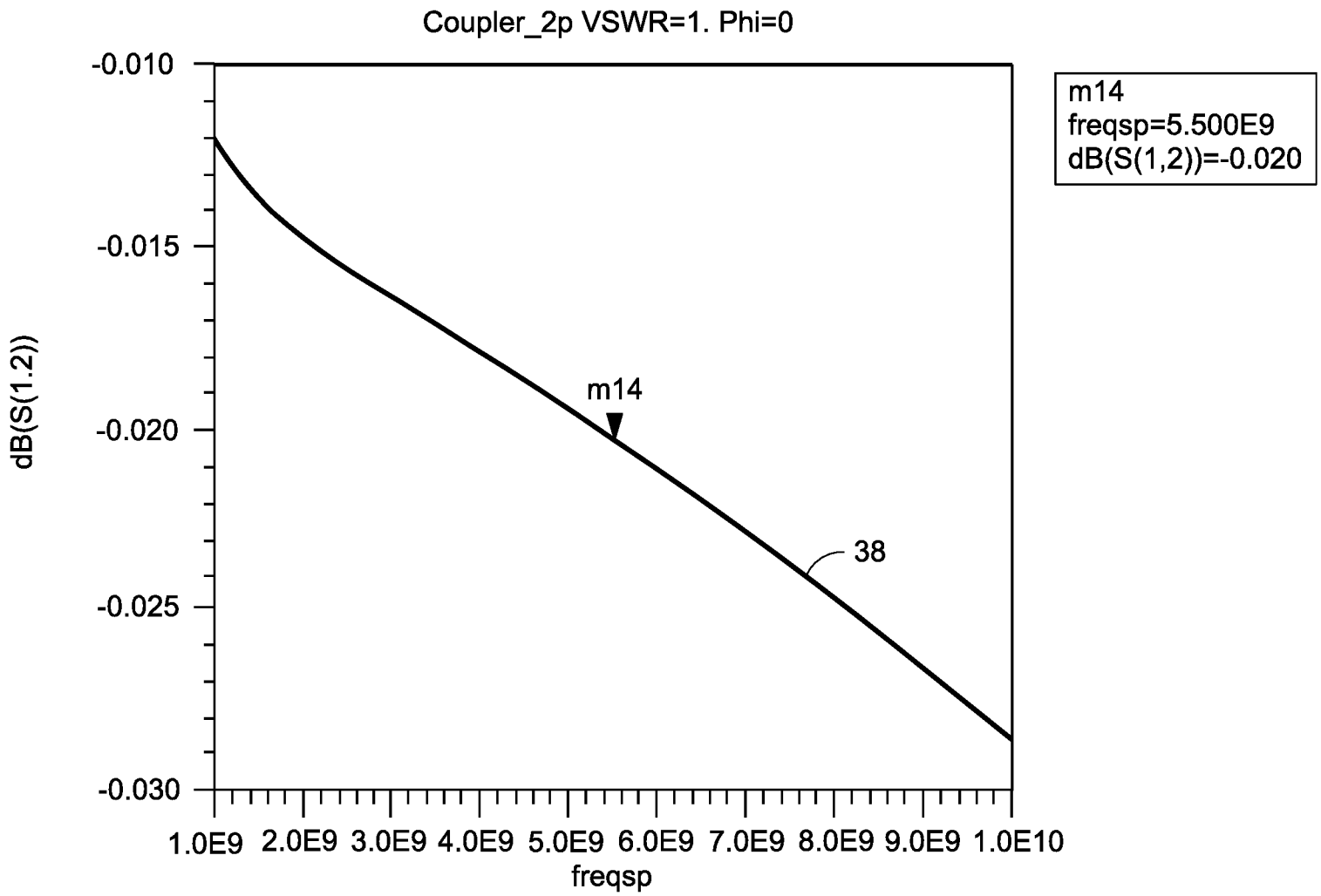
FIG. 2 is a graph showing the insertion loss of the first embodiment of the directional coupler depicted in FIG. 1, over an operating frequency range.

Given the four-port configuration of the first embodiment of the directional coupler 10*a*, the electrical behavior thereof in response to a steady-state input can be described by a set of S-parameters. The simulation results in this and other embodiments disclosed herein are simulated with Momentum EM and Golden Gate simulation tools. The results are based on parameters that are understood to correspond to directional couplers that are fabricated in accordance with a CMOS process. Other semiconductor process may also be applied in the simulations, such as CMOS Silicon-On-Insulator, Silicon Germanium Heterojunction Bipolar Transistor (SiGe HBT), and Gallium arsenide (GaAs). A loss of signal from the input port 16 (P1) to the antenna port 17 (P2) is referred as an insertion loss. The simulated result of insertion loss of the first embodiment of the directional coupler 10*a* over a range of RF signal frequencies is depicted as a plot 38 shown in FIG. 2, where the vertical axis represents insertion loss in [dB], and the horizontal axis represents frequency in [Hz]. The simulation has been performed under the condition that voltage standing wave ratio (VSWR) is set to 1 and phase load is set to 0. As contemplated in accordance with the present disclosure, the plot 38 of the circuit simulation shows that the insertion loss (S12) over various frequencies is near zero (approximately −0.020 dB at 5 GHz).

Figure 3:
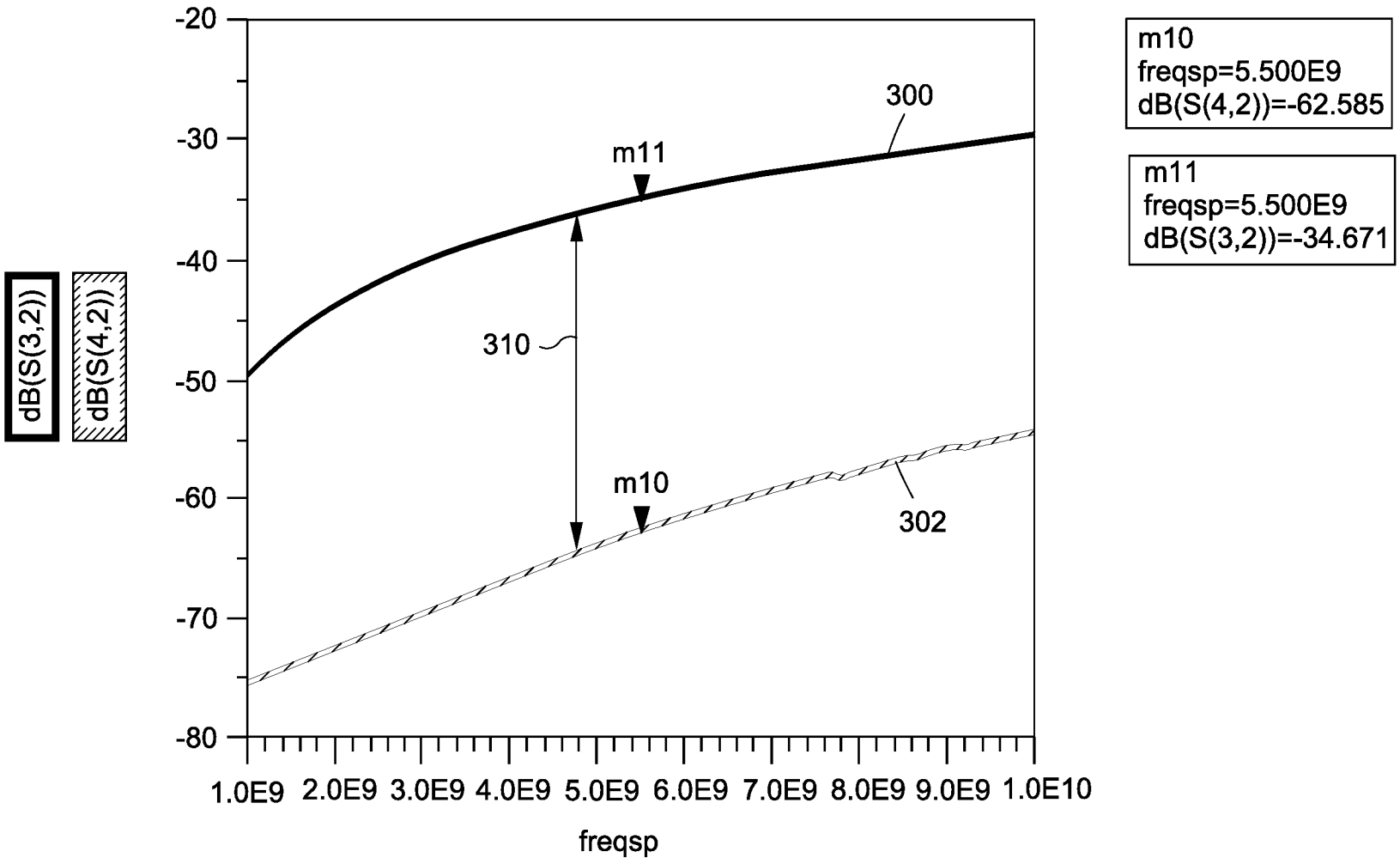
FIG. 3 is a graph showing the scattering parameters (S-parameters) of the first embodiment of the directional coupler shown in FIG. 1 over an operating frequency range, with the coupling factor, isolation factor, and resultant directivity being detailed.

As pertinent to other operational characteristics of the first embodiment of the directional coupler 10*a*, the first signal trace 20 and the inductive winding 28 may be characterized by a predefined coupling factor, that is, the degree to which the signal on the first signal trace 20 is passed or coupled to the inductive winding 28. The coupling factor corresponds to S32, or antenna port-isolation port gain (coupling) coefficient, which is shown in a first plot 300 of FIG. 3. At a 5 GHz operating frequency, the coupling factor is approximately −34 dB. Additionally, the coupled first signal trace 20 and the second signal trace 34 are characterized by an isolation factor between the antenna port 17 (P2) and the detect port 19 (P4). The isolation factor corresponds to S42 shown as a second plot 302 of FIG. 3, and is the degree of isolation between the antenna port 17 (P2) and the detect port 19 (P4). In the example illustrated, the isolation is approximately 62 dB over the 5 GHz to 7 GHz frequency range. The difference between the coupling factors at particular operating frequencies, and the corresponding isolation factors at such operating frequencies, defines a directivity 310. As can be seen, the directivity at frequency 5 GHz is above 25 to 30 dB and this level of directivity is suitable for many applications, including mobile communications. The coupling factor can be defined as S41, and isolation as S31, if the signal is applied to port P1. In general, coupling factors S41 and S31, as well as isolation S31 and S42 could differ from each other.

Figure 4A:
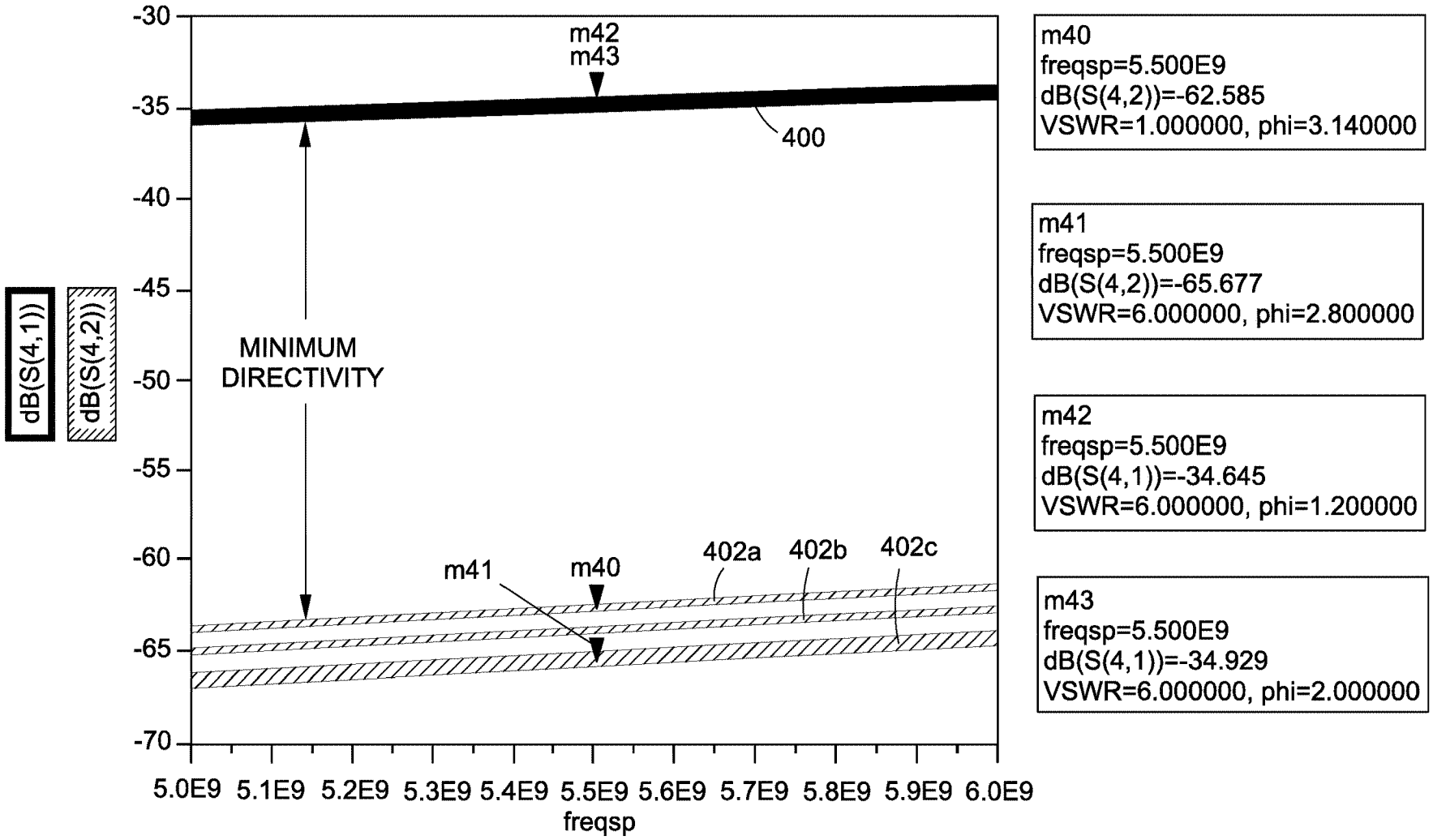
FIG. 4A is a graph showing the S-parameters of the first embodiment of the directional coupler shown in FIG. 1 over different VSWR (voltage standing wave ratio) levels and load phases, with the coupling factor, isolation factor, and minimum directivity being detailed.
Figure 4B:
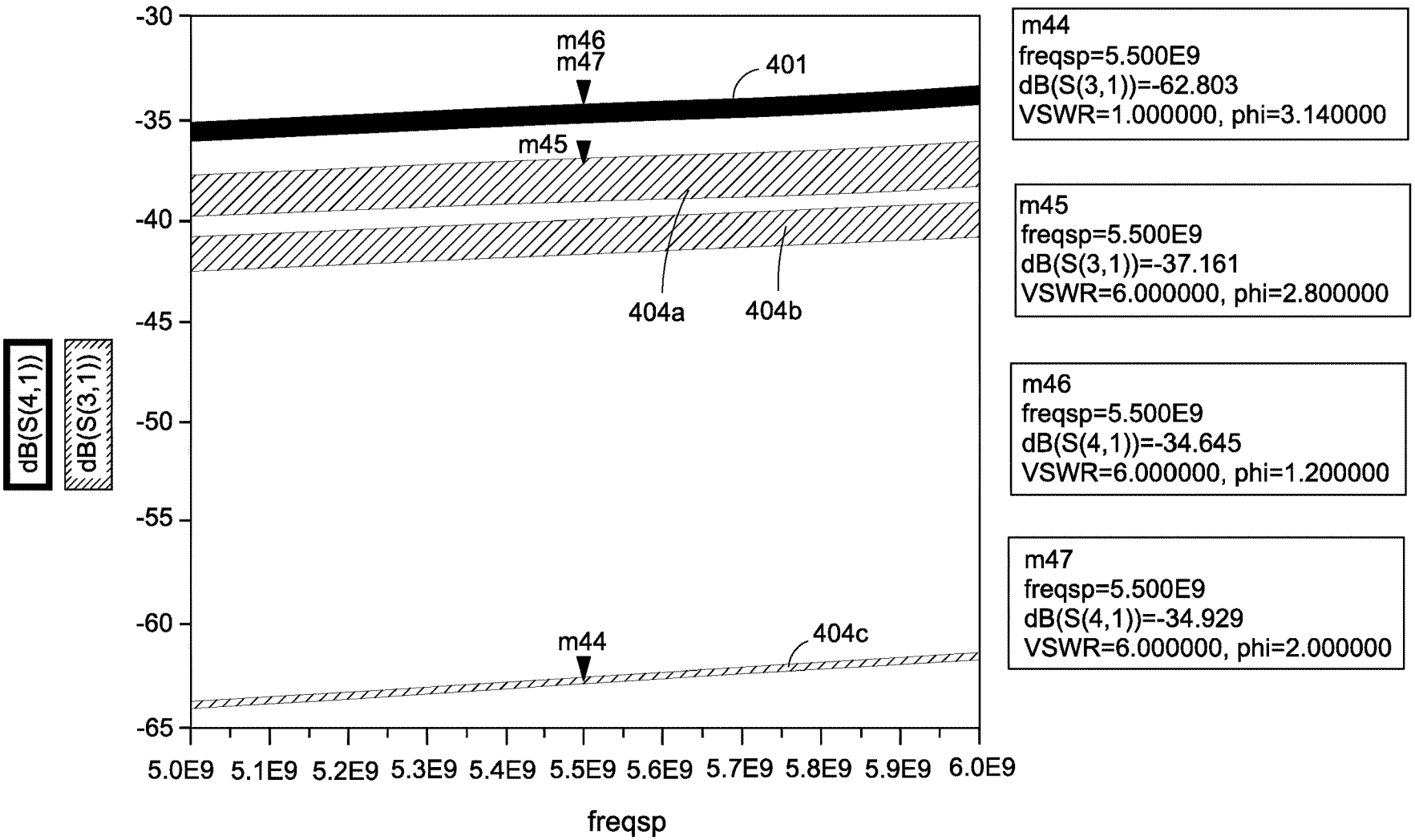
FIG. 4B is a graph showing the S-parameters of the first embodiment of the directional coupler shown in FIG. 1 over different VSWR levels and load phases, with the coupling factor, and isolation factor being detailed.

The graphs of FIGS. 4A-B illustrate the simulated S-parameters of the first embodiment of the directional coupler 10*a* over various frequencies, voltage standing wave ratios (VSWR) levels and phase shifts, where coupling factor variation is less than +/−0.5 dB while VSWR at the antenna port 17 is from 1:1 to 6:1. The coupling factor corresponds to S41, or the gain coefficient between the detect port 19 (P4) and the input port 16 (P1). This is shown in plots 400, 401 of FIGS. 4A, 4B, respectively. The isolation factor S42 is shown in plots 402*a-c* of FIG. 4A, and plots 404*a-c* of FIG. 4B. The plots 402, 404 depict the degree of isolation between the input port 16 (P1) and the isolation port 18 (P3). The minimum directivity (close to 30 dB) of the first embodiment of the directional coupler 10*a* over various frequencies, VSWR and phase shifts, is shown in FIG. 4A. As mentioned above, the minimum directivity meets the requirements of wireless communication transceivers.

Figure 5:
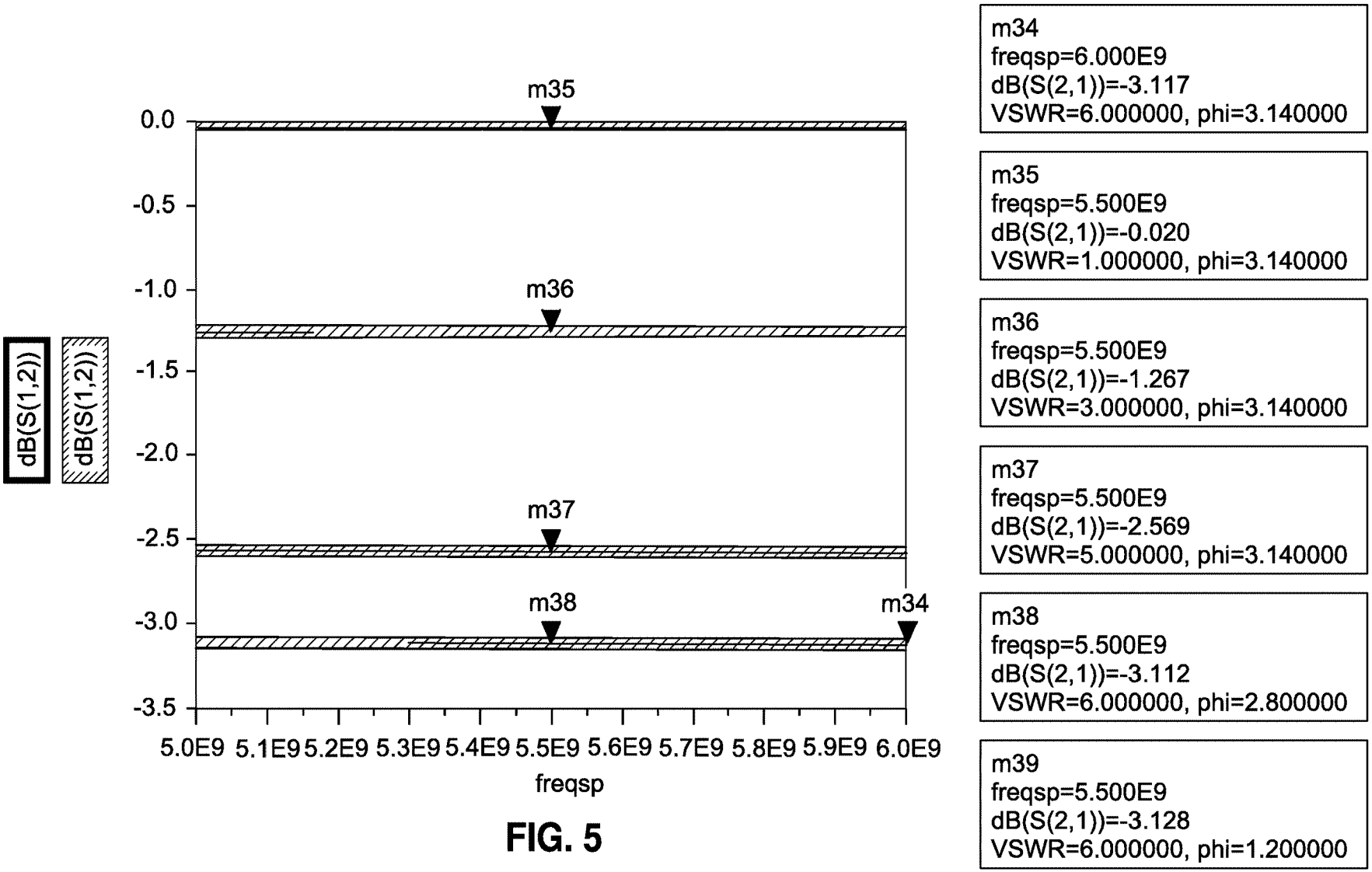
FIG. 5 is a graph showing the S-parameters of the first embodiment of the directional coupler shown in FIG. 1 over different VSWR levels and load phases, with the insertion loss being detailed.

As shown in FIG. 5, insertion loss is very close to zero when VSWR is set to be 1:1. As VSWR increases, insertion loss increases. Furthermore the absolute value of the insertion loss is around 3.1 dB under the condition that VSWR is set to be 6:1.

Figure 6:
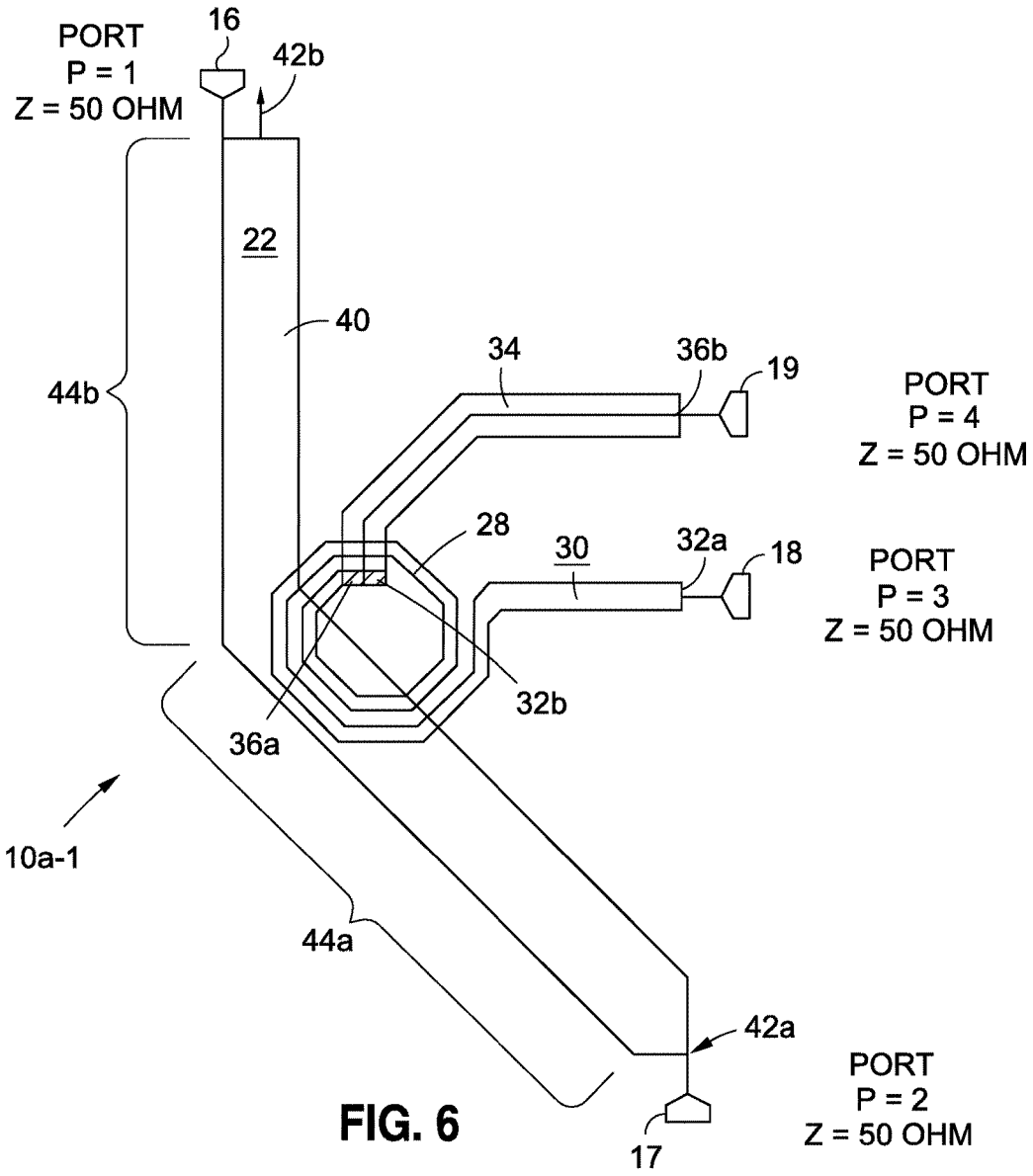
FIG. 6 is a top plan view of a first variation of the first embodiment of the directional coupler.

FIG. 6 is a top plan view of a variant of the first embodiment of the directional coupler 10*a*-1 of the first embodiment of the directional coupler 10*a* depicted in FIG. 1. Similar to the first embodiment of the directional coupler 10*a* described above, the first variant of the first embodiment of the directional coupler 10*a*-1 includes the input port 16, the antenna port 17, an isolation port 18, and the detect port 19. The directional coupler 10*a*-1 also includes a first signal trace 40 that is disposed on the first conductive layer 22. The first signal trace 40 further includes a first terminal 42*a* and a second terminal 42*b* at opposite ends thereof. In further detail, the first signal trace 40 is defined by a first section 44*a* and a second section 44*b*. The first terminal 42*a* is proximal to the first section 44*a* and is connected to the antenna port 17. The second terminal 42*b* is proximal to the second section 44*b* and is connected to the input port 16. In accordance with the first variant of the first embodiment of the directional coupler 10*a*-1, the first section 44*a* of the first signal trace 40 is longer than that of the previously described first embodiment of the directional coupler 10*a*, i.e., the first section 24*a* of the first signal trace 20. The second section 44*b* of the first signal trace 40 in the first variant of the first embodiment of the directional coupler 10*a*-1 is also longer than the corresponding second section 24*b* of the first signal trace 20 in the first embodiment of the directional coupler 10*a*. Similar to the first embodiment of the directional coupler 10*a*, the width of the first section 44*a* of the first signal trace 40 is greater than the width of the second section 44*b* of the first signal trace 40.

Again, the first variant of the first embodiment of the directional coupler 10*a*-1 incorporates the same inductive winding 28, which may be disposed on the second conductive layer 30 that is in a substantially parallel relationship to the first conductive layer 22. The inductive winding 28 has at least one turn, and includes the two terminals 32*a* and 32*b*. The first terminal 32*a* is connected to or is otherwise integral with the isolation port 18. The inductive winding 28 at least partially overlaps the first signal trace 40. The first variant of the first embodiment of the directional coupler 10*a*-1 further includes the second signal trace 34 with the first terminal 36*a* at one end and the second terminal 36*b* at the other end. The first terminal 36*a* is connected to the second terminal 32*b* of the inductive winding 28, while the second terminal 36*b* is connected to the detect port 19.

Figure 7B:
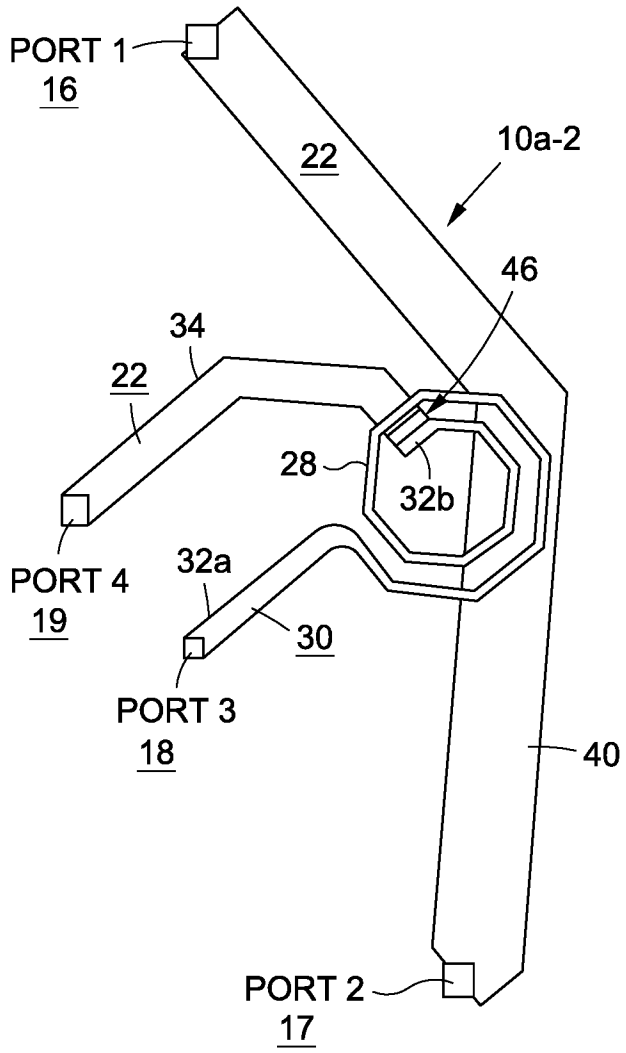
FIG. 7B is a bottom perspective view of the first variation of the first embodiment of the directional coupler.
Figure 7A:
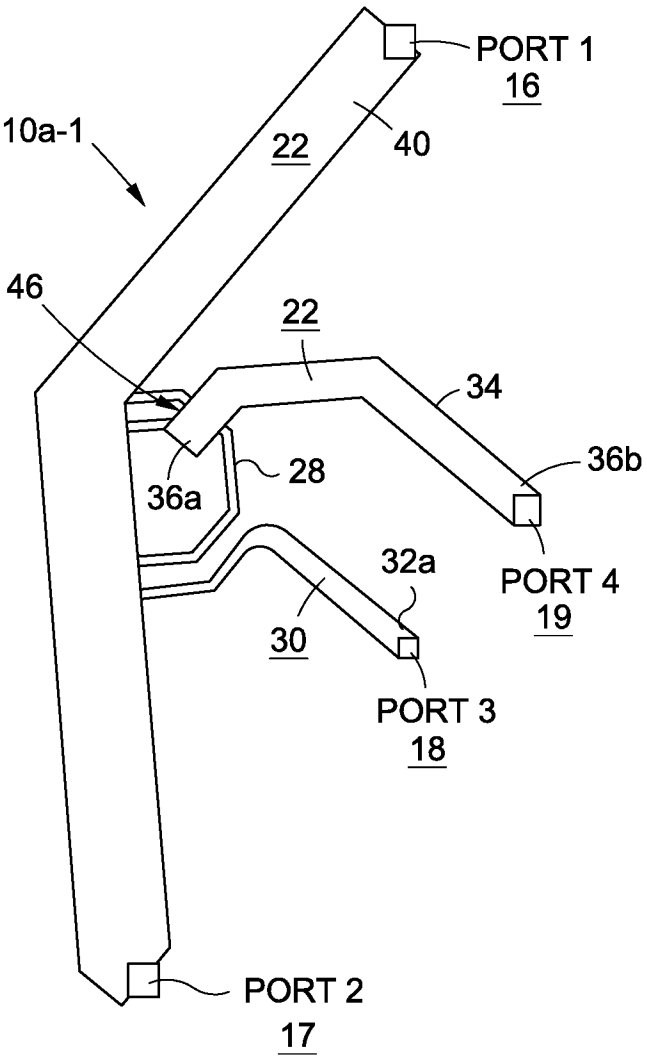
FIG. 7A is a top perspective view of the first variation of the first embodiment of the directional coupler.

FIG. 7A and FIG. 7B are three-dimensional renditions of the first variant of the first embodiment of the directional coupler 10*a*-1, with FIG. 7A showing a view from the top, and FIG. 7B showing a view from the bottom. As discussed above, due to the spiral configuration of the inductive winding 28, the second terminal 32*b* thereof is positioned in its interior. The second signal trace 34 may therefore be disposed on the first conductive layer 22 that is above the second conductive layer 30 on which the inductive winding 28 is disposed. There may be a vertical trace 46 that interconnects the second terminal 32*b* of the inductive winding 28 to the first terminal 36*a* of the second signal trace 34. Although the second signal trace 34 is described and shown as being disposed on the first conductive layer 22, and hence coplanar with the first signal trace 40, though this is by way of example only and not of limitation. In other words, the second signal trace 34 may be disposed on yet a further different conductive layer that is not necessarily co-planar with the first conductive layer 22.

Figure 8:
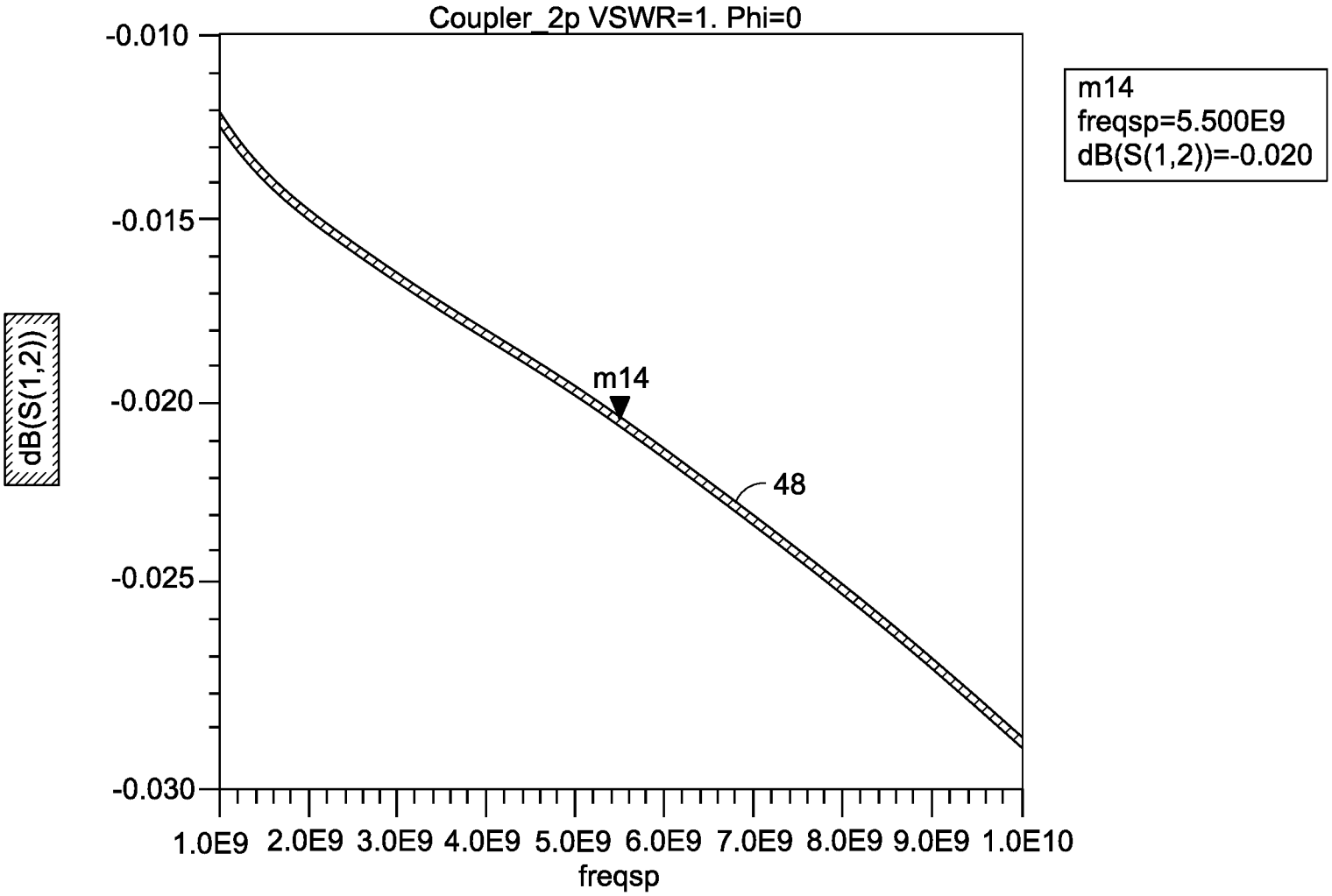
FIG. 8 is a graph showing the insertion loss of the first variation of the first embodiment of the directional coupler shown in FIGS. 6, 7A, and 7B over an operating frequency range.
Figure 9:
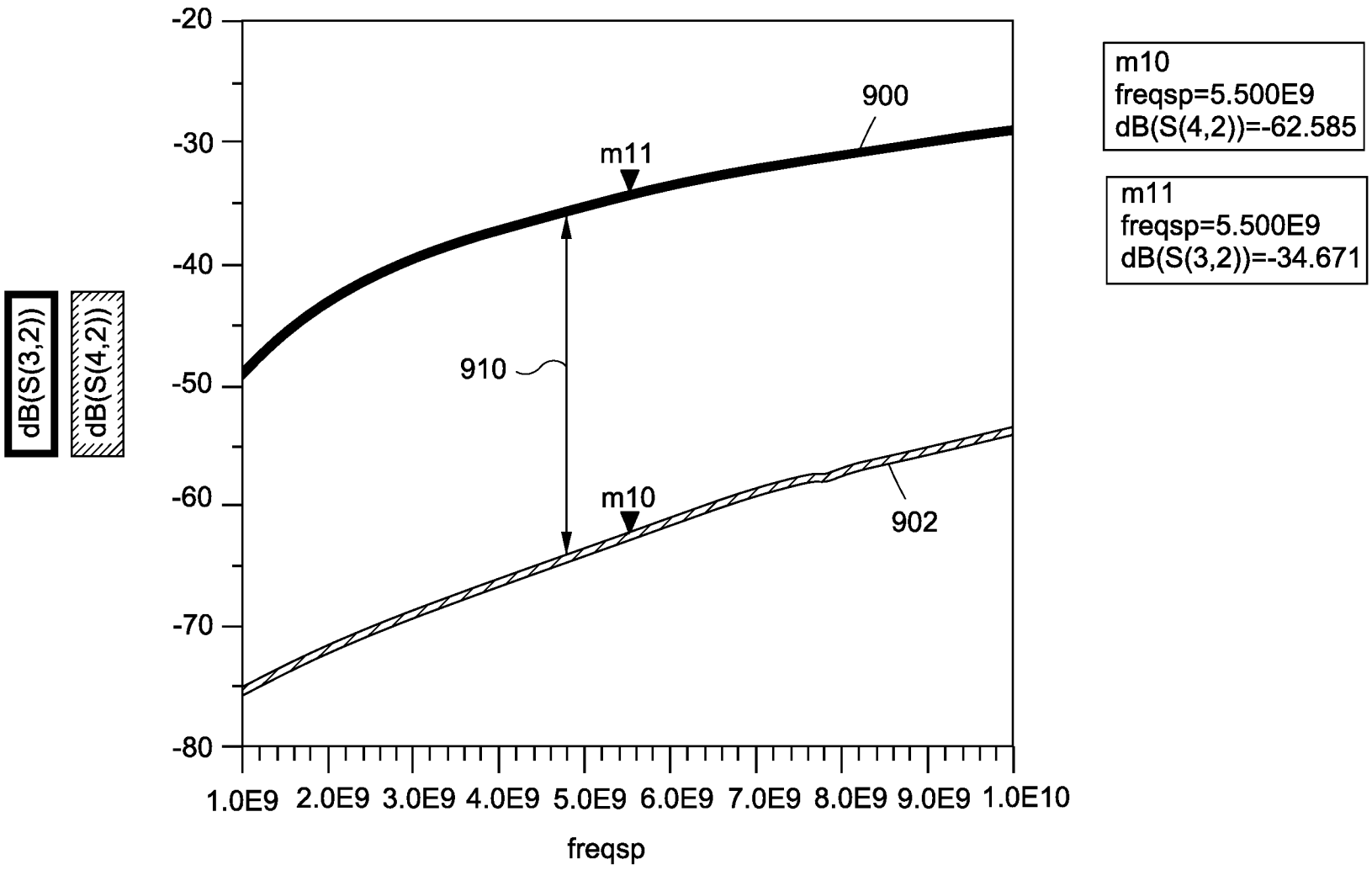
FIG. 9 is a graph showing the S-parameters of the first variation of the first embodiment of the directional coupler shown in FIGS. 6, 7A, and 7B over an operating frequency range, with the coupling factor, isolation factor, and resultant directivity being detailed.

The simulated performance of the first variant of the first embodiment of the directional coupler 10*a*-1 will now be described with reference to the graphs of FIGS. 8, 9, 10A, 10B, and 11. The graphs generally correspond to the graphs of FIGS. 2, 3, 4A, 4B, and 5, respectively, which are specific to the first embodiment of the directional coupler 10*a*, but otherwise plot the same performance parameters. Thus, FIG. 8 shows, in a plot 48, the simulated insertion loss of the first variant of the first embodiment of the directional coupler 10*a*-1. Specifically, it is shown that the insertion loss (S12) over various frequencies is near zero (approximately −0.020 dB at 5 GHz). FIG. 9 includes a first plot 900 that shows the coupling factor being approximately −34 dB over 5 GHz frequency range, along with a second plot 902 that shows an isolation of approximately 63 dB over the entirety of the plotted frequency range. Directivity 902, or the difference between the coupling factor and the isolation, is above approximately 29 dB over the entirety of the plotted frequency range.

Figure 10A:
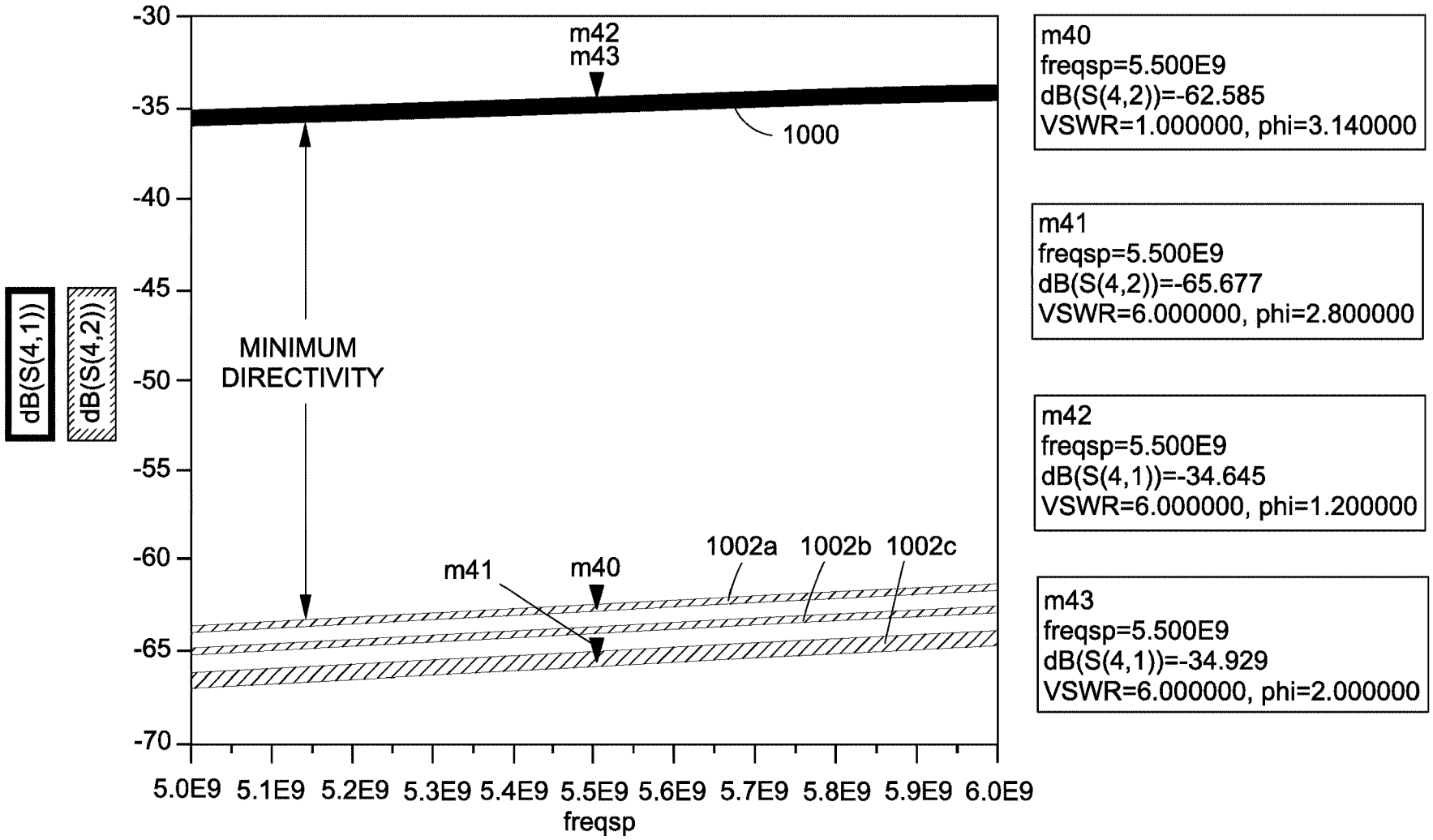
FIG. 10A is a graph showing the S-parameters of the first variation of the first embodiment of the directional coupler shown in FIGS. 6, 7A, and 7B over different VSWR levels and load phases, with the coupling factor, isolation factor, and minimum directivity being detailed.
Figure 10B:
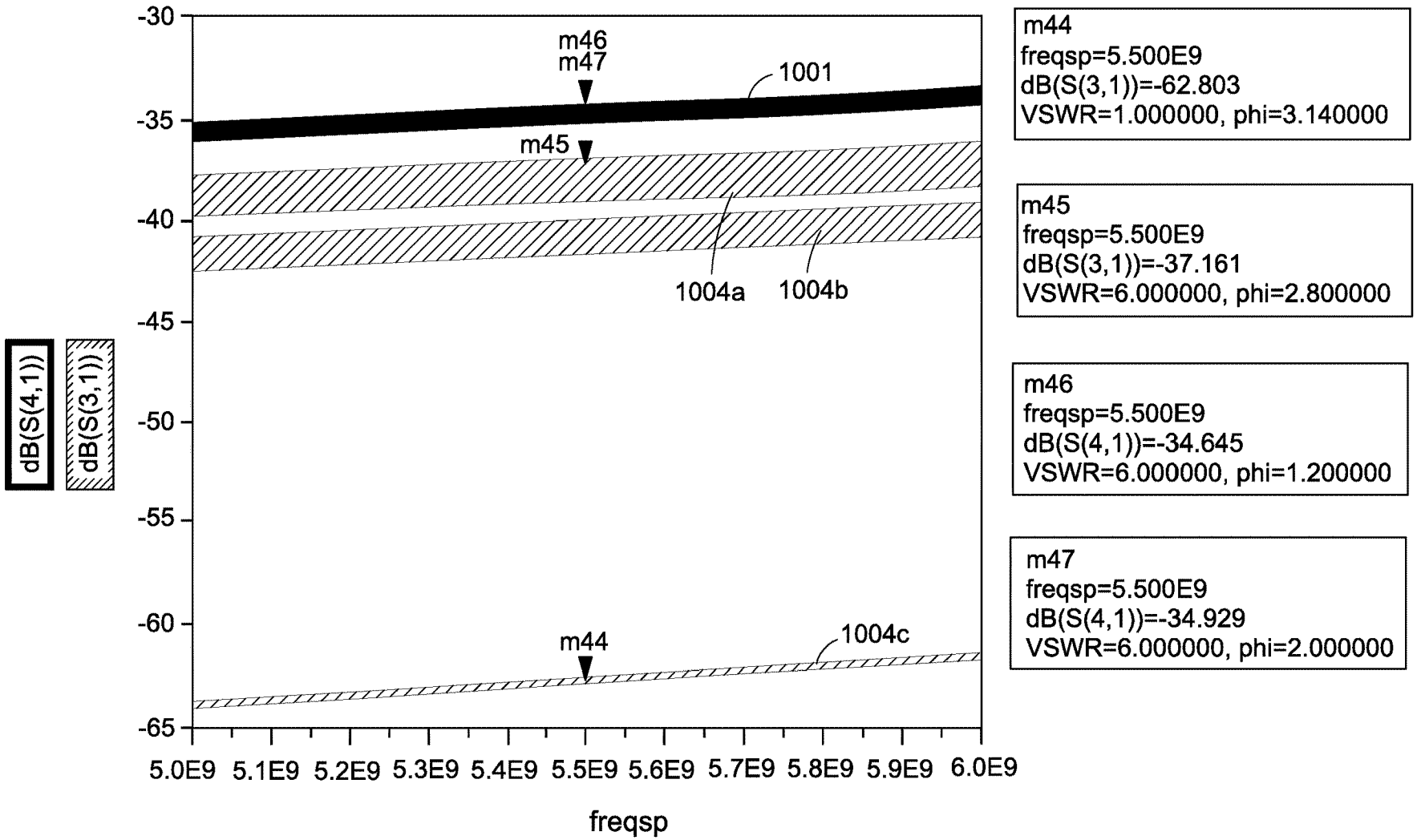
FIG. 10B is a graph showing the S-parameters of the first variation of the first embodiment of the directional coupler shown in FIGS. 6, 7A, and 7B over different VSWR levels and load phases, with the coupling factor, and isolation factor being detailed.
Figure 11:
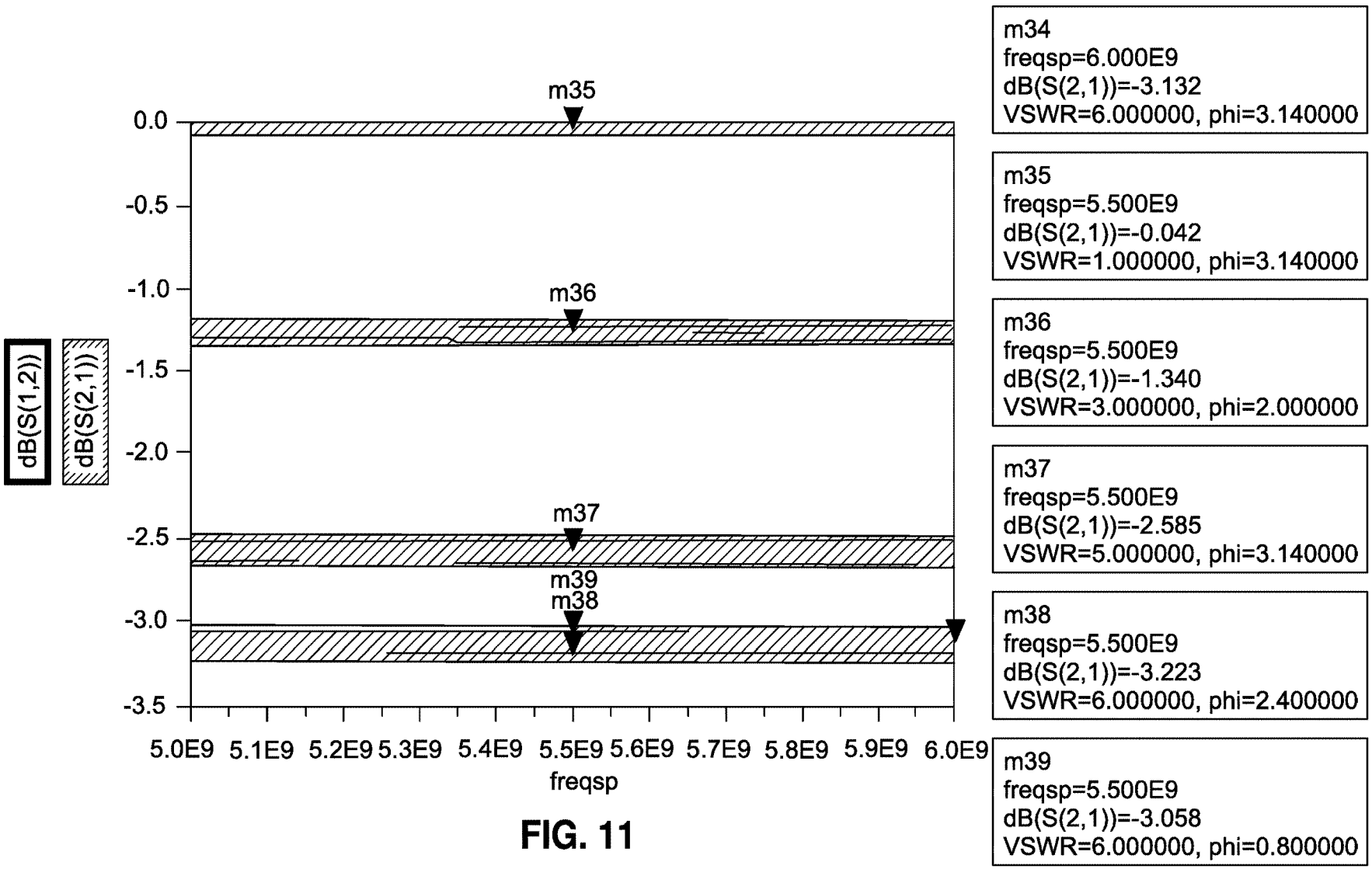
FIG. 11 is a graph showing the S-parameters of the first variation of the first embodiment of the directional coupler shown in FIGS. 6, 7A, and 7B over different VSWR levels and load phases, with the insertion loss being detailed.

The graphs of FIGS. 10A-B illustrate the simulated S-parameters of the first variant of the first embodiment of the directional coupler 10*a*-1 over various frequencies, voltage standing wave ratios (VSWR) levels and phase shifts, where coupling factor variation is less than +/−0.5 dB while VSWR at the antenna port 17 is from 1:1 to 6:1. The coupling factor S41 is shown in both FIGS. 10A and 10B as plots 1000 and 1001, respectively. The isolation factor S42 is shown in plots 1002*a-c* of FIG. 10A, and plots 1004*a-c* of FIG. 10B. The plots 1002, 1004 depict the degree of isolation between the input port 16 (P1) and the isolation port 18 (P3). FIG. 11 further shows that insertion loss is very close to zero when VSWR is set to be 1. In general, the performance of the first variant of the first embodiment of the directional coupler 10*a*-1 is substantially the same as that of the first embodiment of the directional coupler 10*a*. Hence, the length of the first signal trace 40 is understood to have little to no influence on the performance parameters of the directional coupler 10.

Figure 12:
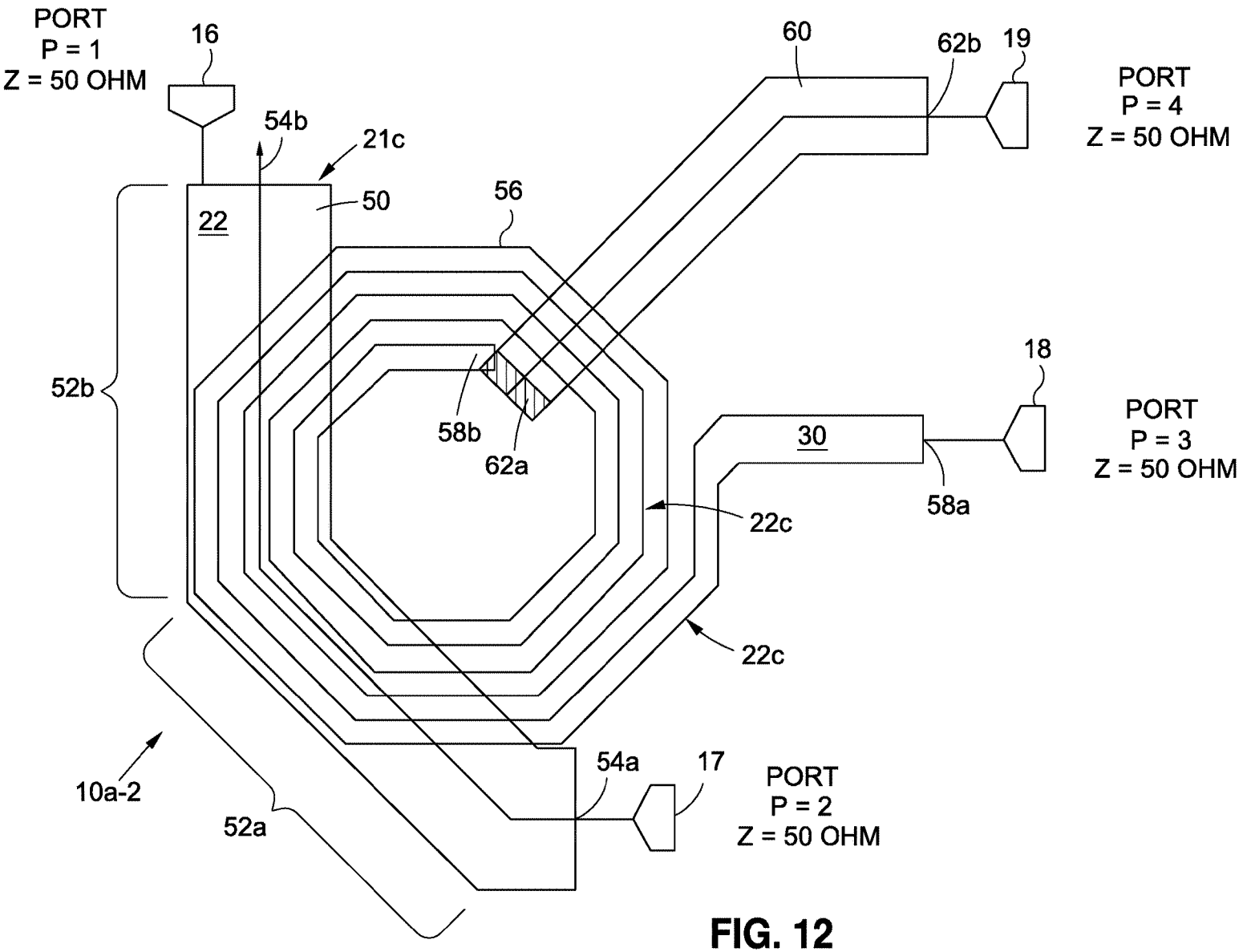
FIG. 12 is a top plan view of a second variation of the first embodiment of the directional coupler.

FIG. 12 is a top plan view of a second variant of a first embodiment of a directional coupler 10*a*-2. Similar to the first embodiment of the directional coupler 10*a* shown in FIG. 1 and the first variant of the first embodiment of the directional coupler 10*a*-1 shown in FIG. 6, the second variant of the first embodiment of the directional coupler 10*a*-2 includes the input port 16, the antenna port 17, the isolation port 18, and the detect port 19. The second variant of the first embodiment of the directional coupler 10*a*-2 may include a first signal trace 50 that is disposed on the first conductive layer 22, and defined by a first section 52*a* and a second section 52*b*. Unlike the earlier described first embodiment 10*a*, the width of the first section 52*a* contemplated to be equal to, or at least substantially equal to, the width of the second section 52*b*. The first signal trace 50 has a first terminal 54*a* connected to the antenna port 17, as well as a second terminal 54*b* on the other end of the first signal trace 50 that is a connection point to the input port 16.

The second embodiment of the directional coupler 10*b* further includes an alternatively configured inductive winding 56 with a first terminal 58*a* on one end thereof, and a second terminal 58*b* on the opposite end thereof. According to this embodiment, the inductive winding 56 has three turns, and is understood to be disposed on the second conductive layer 30. Again, the first conductive layer 22 is understood to be in a substantially parallel relationship to the second conductive layer 30. In this regard, the first signal trace 50 overlaps at least a section of the inductive winding 56.

Figure 13B:
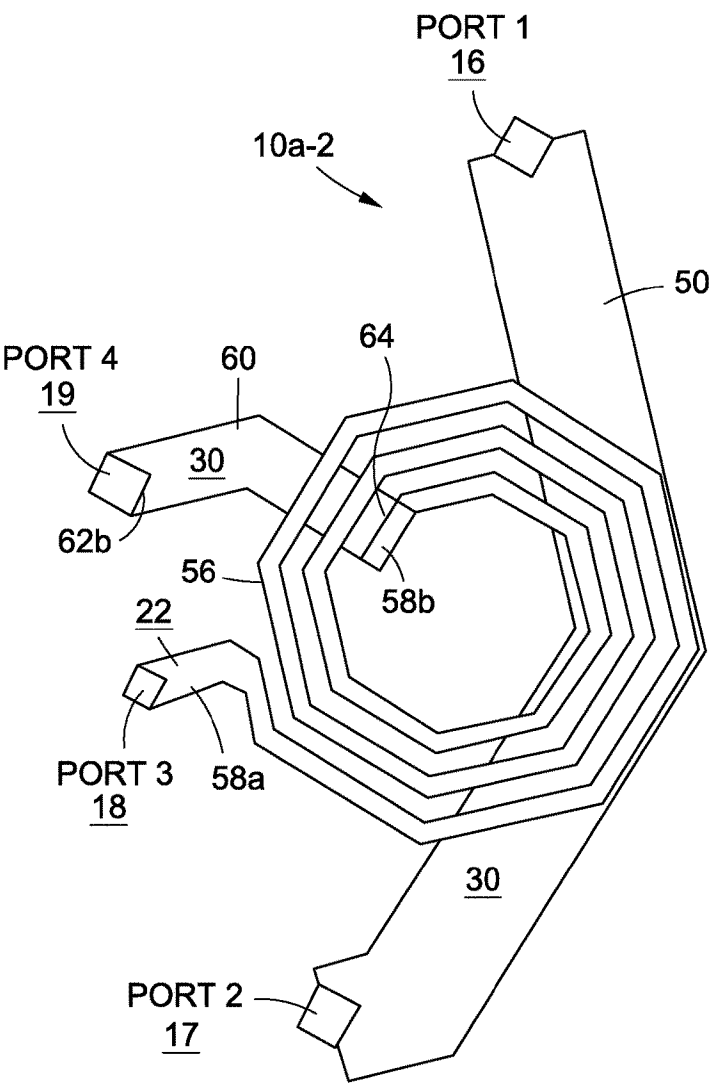
FIG. 13B is a bottom perspective view of the second variation of the first embodiment of the directional coupler.
Figure 13A:
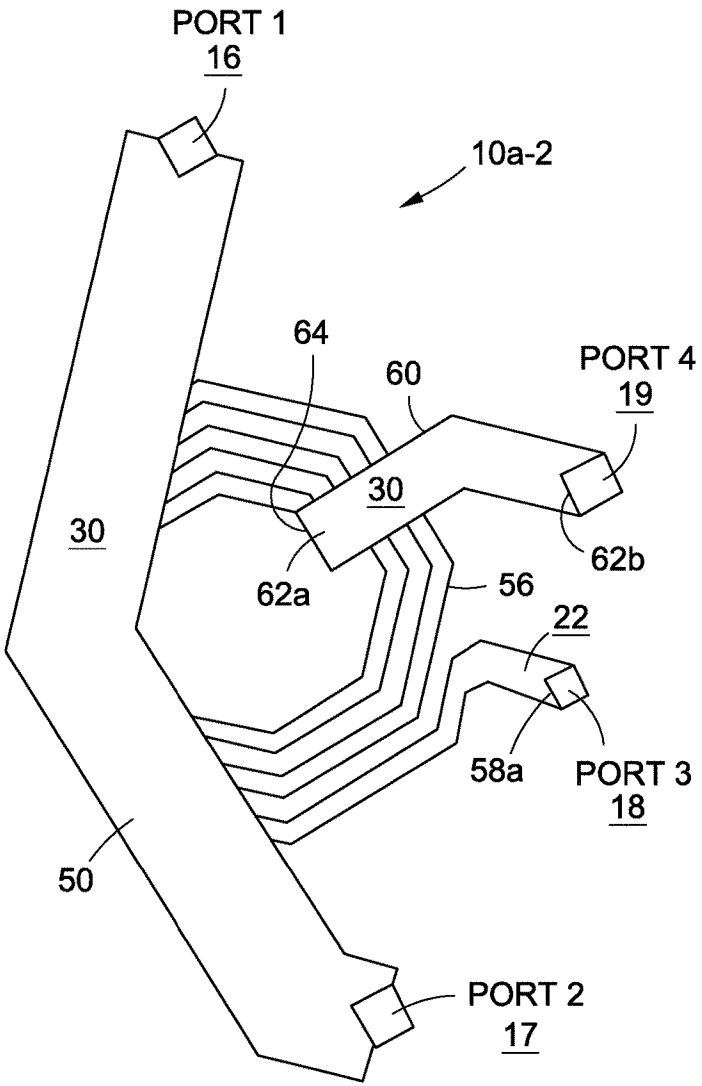
FIG. 13A is a top perspective view of a second variation of the first embodiment of the directional coupler.
Figure 14:
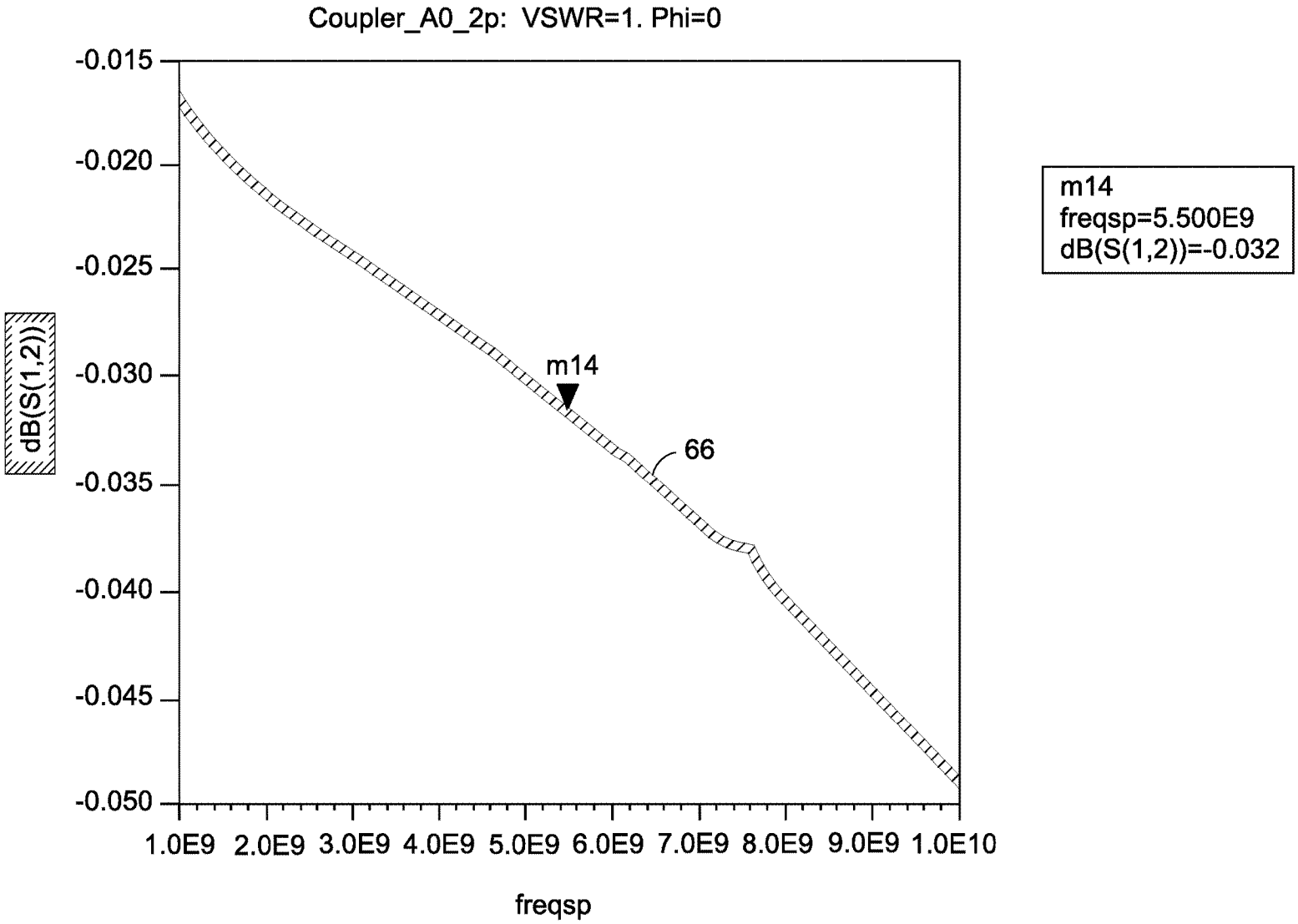
FIG. 14 is a graph showing the insertion loss of the second variation of the first embodiment of the directional coupler shown in FIGS. 12, 13A, and 13B over an operating frequency range.
Figure 15:
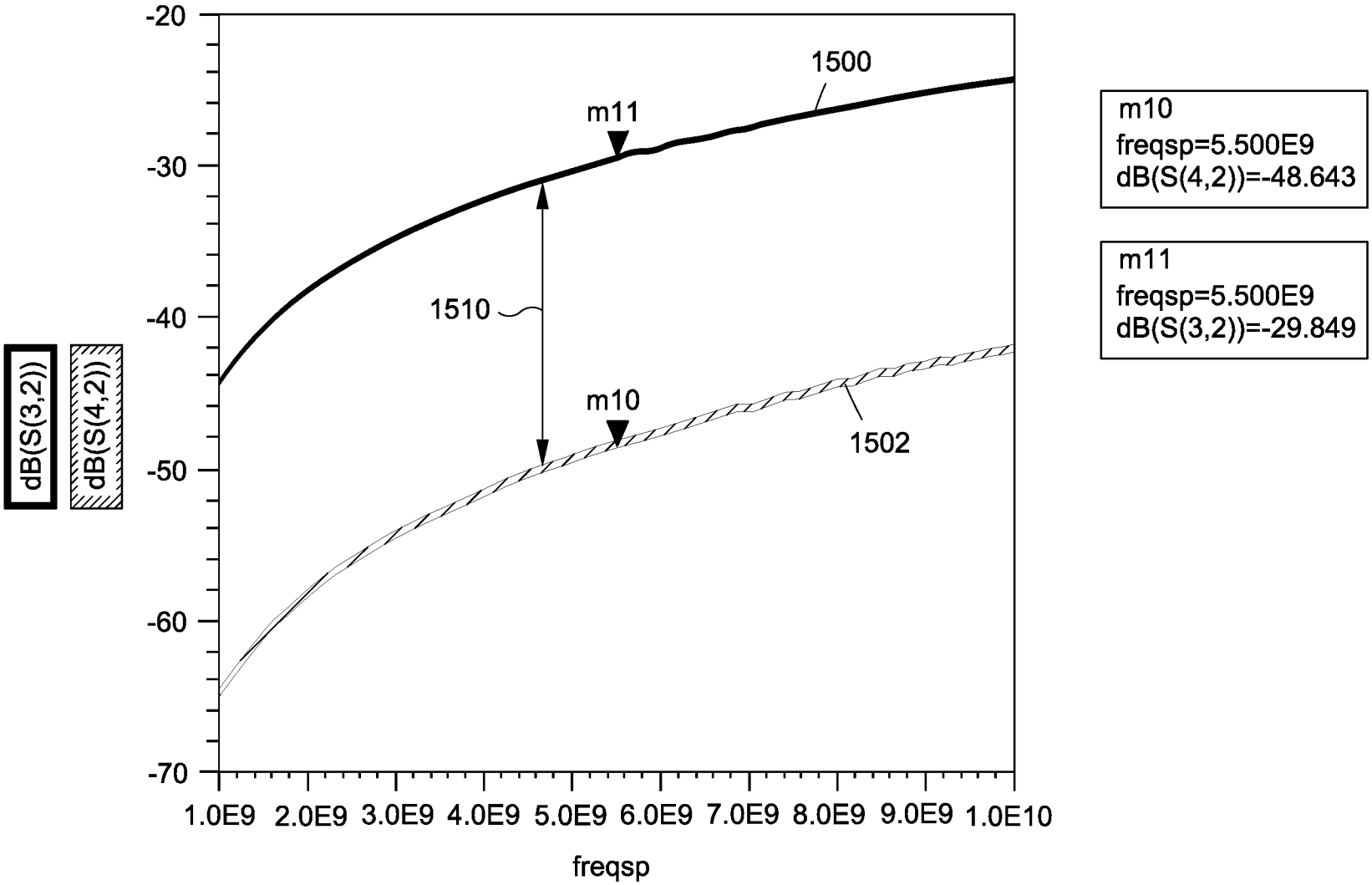
FIG. 15 is a graph showing the S-parameters of the second variation of the first embodiment of the directional coupler shown in FIGS. 12, 13A, and 13B over an operating frequency range, with the coupling factor, isolation factor, and resultant directivity being detailed.

The second embodiment of the directional coupler 10*b* further includes a second signal trace 60 that is routed above or below a section of the inductive winding 56. The second signal trace 60 includes a first terminal 62*a* that is connected to the second terminal 58*b* of the inductive winding 56. As shown in the three-dimensional representations of FIGS. 13A and 13B, there is a vertical trace 64 that extends between the first conductive layer 22 and the second conductive layer 30, that is, the second terminal 58*b* of the inductive winding 56 and the first terminal 62*a* of the second signal trace 60. The second signal trace 60 also includes a second terminal 62*b* that is connected or otherwise integral with the detect port 19. As with the first embodiment of the directional coupler 10*a*, although the second signal trace 60 is described as being disposed on the second conductive layer 30, this is optional. The second signal trace 60 may be vertically routed to another intermediate layer if desired, and not necessarily to the first conductive layer 22.

By way of example only and not of limitation, the width of the first signal trace 50 is approximately 15 μm. Furthermore, the footprint/dimension of the inductive winding 56 may be approximately 52 μm×52 μm, while the width of the trace comprising the inductive winding 56 may be approximately 2.63 μm. Its thickness may be approximately 0.56 μm. The spacing or distance between individual turns of the inductive winding 56 is, by way of example, approximately 2.57 μm. As indicated above, the intermediate space distance between the first conductive layer 22 and the second conductive layer 30 upon which the first signal trace and the second signal trace are disposed, on one hand, and the inductive winding 56 is disposed, on the other hand, respectively, in this example is approximately 0.95 μm.

The performance of the second embodiment of the directional coupler 10*b* is illustrated in FIGS. 14, 15, 16A, 16B, and 17. The graphs similarly plot various S-parameters of a simulation of the second embodiment of the directional coupler in the same manner as above in relation to FIGS. 8 9, 10A, 10B, and 11 for the first variant of the first embodiment of the directional coupler 10*a*-1 as well as FIGS. 2, 3, 4A, 4B and 5 for the first embodiment of the directional coupler 10*a*.

Figure 16A:
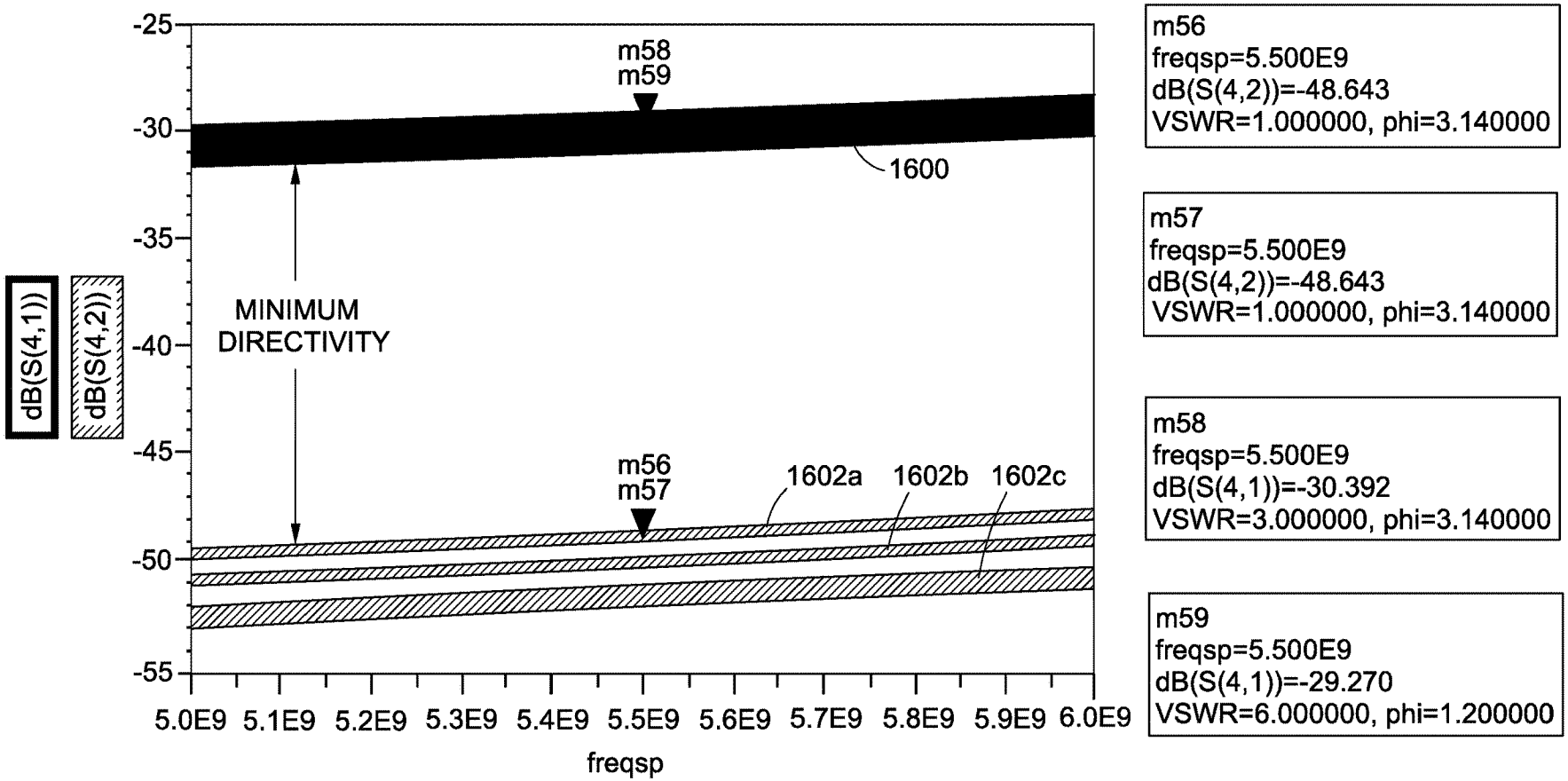
FIG. 16A is a graph showing the S-parameters of the second variation of the first embodiment of the directional coupler shown in FIGS. 12, 13A, and 13B over different VSWR levels and load phases, with the coupling factor, isolation factor, and minimum directivity being detailed.
Figure 16B:
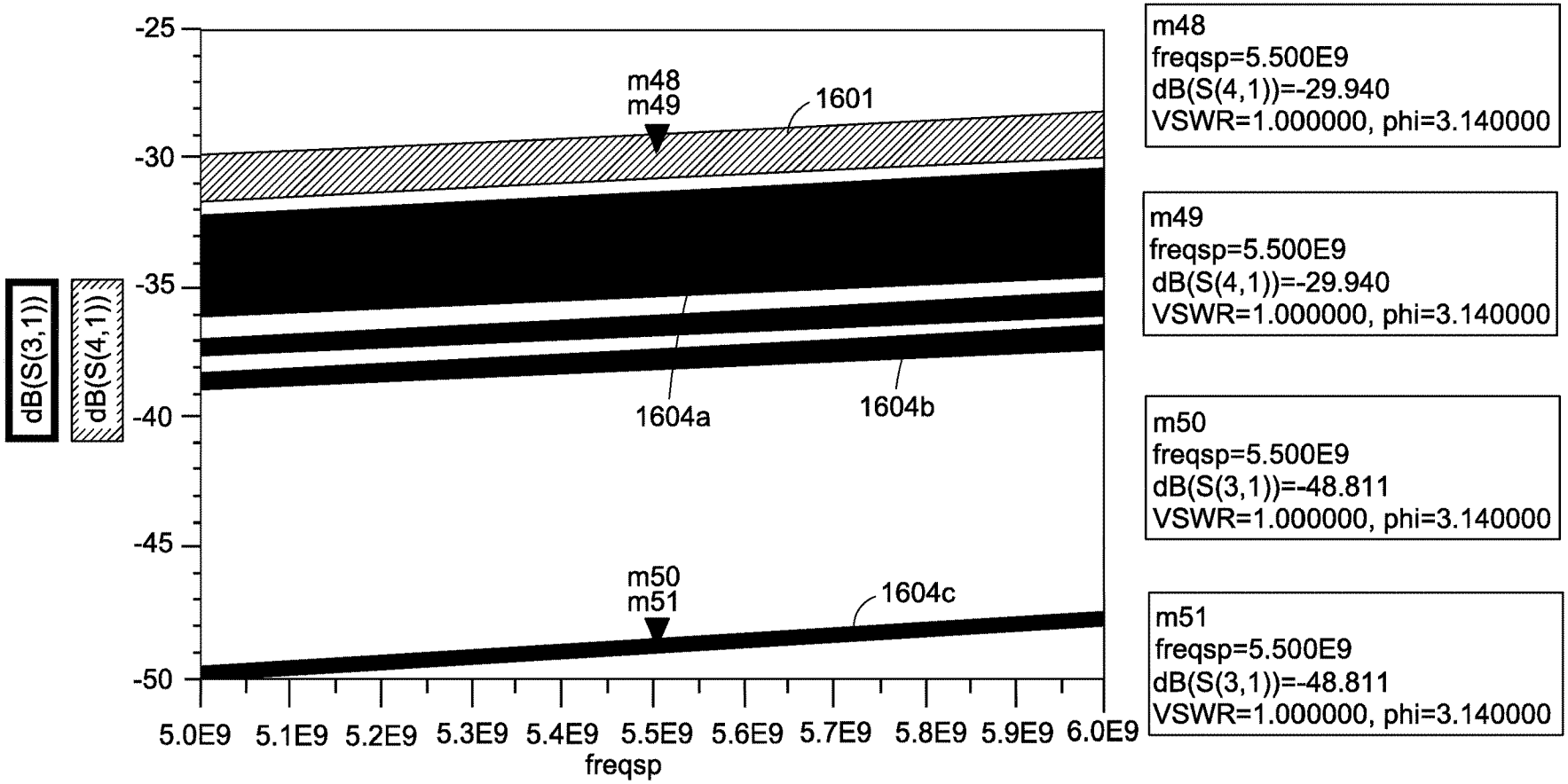
FIG. 16B is a graph showing the S-parameters of the second variation of the first embodiment of the directional coupler shown in FIGS. 12, 13A, and 13B over different VSWR levels and load phases, with the coupling factor, and isolation factor being detailed.
Figure 17:
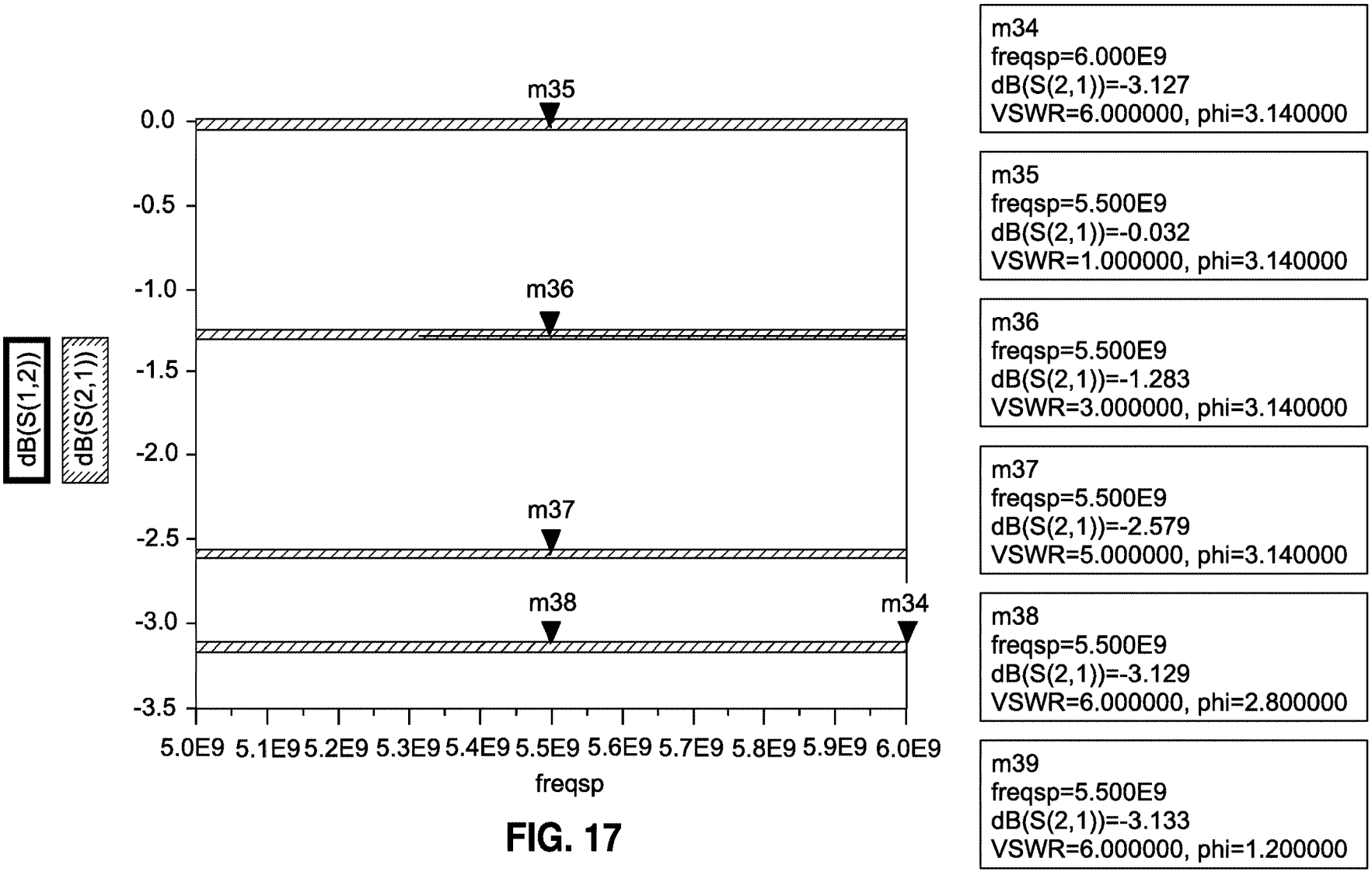
FIG. 17 is a graph showing the S-parameters of the second variation of the first embodiment of the directional coupler shown in FIGS. 12, 13A, and 13B over different VSWR levels and load phases, with the insertion loss being detailed.

Generally, in comparison to the simulated insertion losses for the first embodiment of the directional coupler 10*a*, and for the first variation of the first embodiment of the directional coupler 10*a*-1, the insertion loss of the second embodiment of the directional coupler 10*b* is slightly higher at certain frequencies. For example, as shown in a plot 66 of FIG. 14, at the 5.5 GHz frequency, the insertion loss (which is 0.03 dB) is higher than the insertion loss for the first embodiment of the directional coupler 10*a* (which is 0.02 dB). In addition, with reference to FIG. 15, the coupling factor shown in plot a 1500 is understood to be higher because of the increased coupling area between the first signal trace 50 and the inductive winding 56, as well as the footprint area and number of turns of the inductive winding 56 being larger, at approximately 52 μm×52 μm. Isolation is also shown as plot 1502. The directivity 1510 of the second embodiment of the directional coupler 10*b* is decreased, though still around 20 dB. The level of directivity is understood to be suitable for wireless communication transceivers. FIGS. 16A-B plot the simulation results for coupling factor (plot 1600, plot 1601), isolation factor (plots 1602*a*-1602*c*, plots 1604*a*-1604*c*) and directivity of the second embodiment of the directional coupler 10*b* over various frequencies, VSWR levels and phase shifts, where coupling factor variation is less than +/−0.7 dB while VSWR at the antenna port is up to 6:1. With the increased coupling area as explained above, the second embodiment of the directional coupler 10*b* has a higher coupling factor. As can be seen in FIG. 17, insertion loss of the directional coupler 10*a*-2 is close to zero over various frequencies, VSWR levels and phase shifts.

Figure 18:
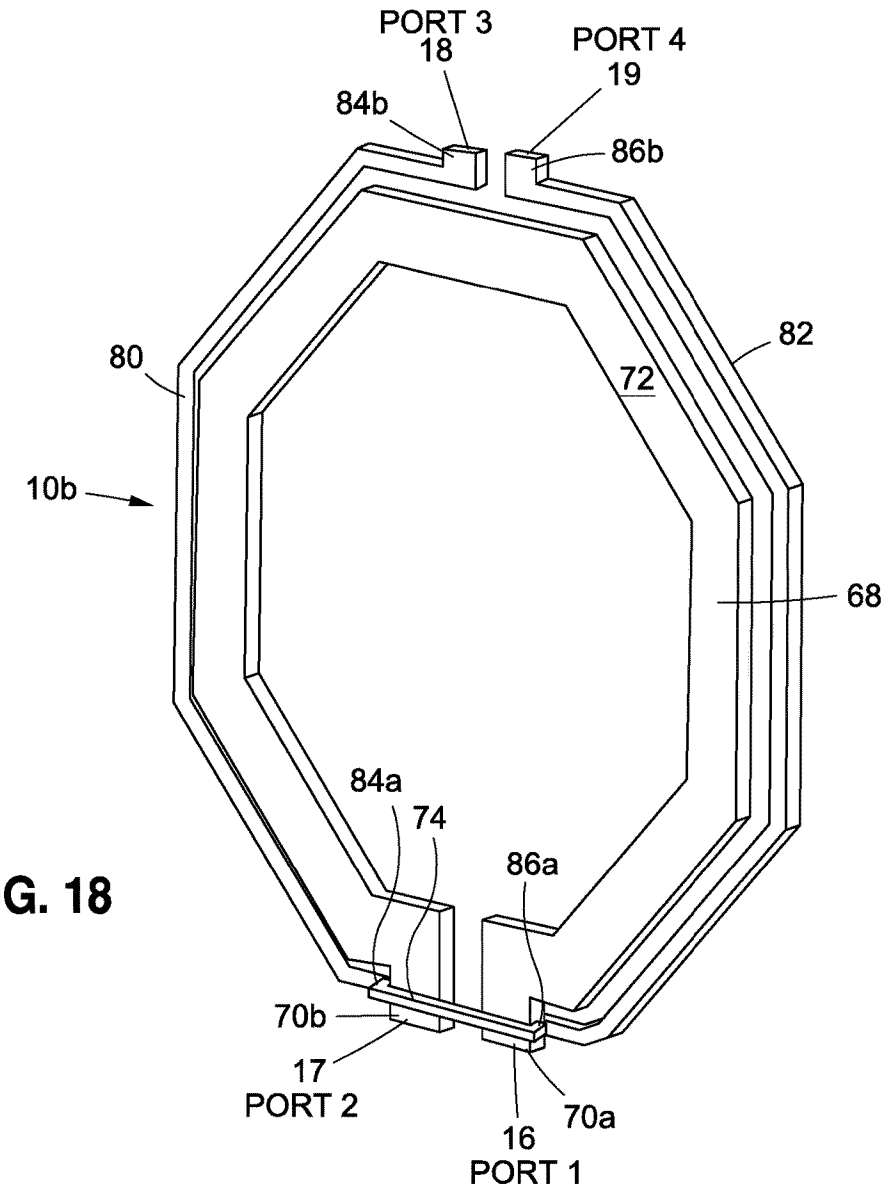
FIG. 18 is a perspective view of a second embodiment of the directional coupler.

FIG. 18 illustrates a second embodiment of the directional coupler 10*b*, which, like the previously described embodiments and variants, also has the input port 16 (Port P1), the antenna port 17 (Port P2), the isolation port 18 (Port P3), and the detect port 19 (Port P4). In further detail, the second embodiment of the directional coupler 10*b* includes a single turn inductor 68 with a first terminal 70*a* and a second terminal 70*b*. The single turn inductor 68 is generally defined by a partial looped configuration with a first loop end corresponding to the first terminal 70*a* and a second loop end corresponding to the second terminal 70*b*. Furthermore, the looped configuration may be defined by an octagonal shape with eight straight segments that are angled relative to each other. The first loop end/first terminal 70*a* and the second loop end/second terminal 70*b* are understood to be located within one such straight segment. The single turn inductor 68 is understood to be disposed on a first conductive layer 72. The first terminal 70*a* is connected to the input port 16 (P1), while the second terminal 70*b* is connected to the antenna port 17 (P2). By way of example only and not of limitation, the dimension of the single turn inductor 68 may be approximately 166 μm×166 μm, and the width of the conductive trace of the single turn inductor 68 may be approximately 15 μm.

Figure 23:
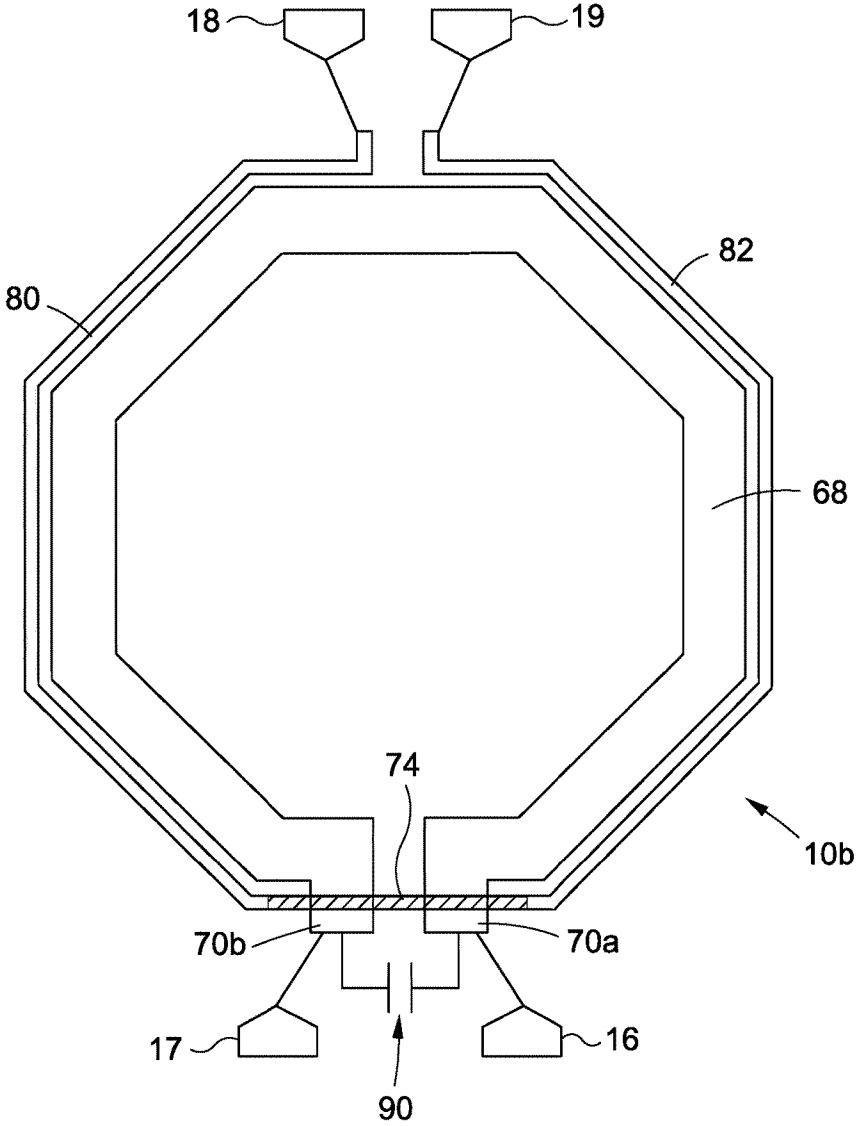
FIG. 23 is a top plan view of a first variant of the second embodiment of the directional coupler.

As best shown in FIG. 23, there is also a harmonic blocking capacitor 90 that is connected in parallel with the single turn inductor 68. This is understood to define a parallel resonance network at second harmonic frequencies, which can be inserted in series into the signal line and connected between the power amplifier output matching network and the antenna. It is expressly contemplated that the parallel resonance network operates as a second harmonic blocker. Thus, the directional coupler 10 may be inserted into the transmission line that guides the signal to the antenna, and may be inserted into more complicated structures as a harmonic rejection network. As will be described in further detail below, this embodiment of the directional coupler 10 has good directivity characteristics.

In addition, there is a first transmission line 80 and a second transmission line 82. The first transmission line 80 at least partially axially surrounds the single turn inductor 68, and includes a first terminal 84*a* and a second terminal 84*b*. The second terminal 84*b* of the first transmission line 80 corresponds to, is integral with, or is otherwise connected to the isolation port 18 (P3). The second transmission line 82 also at least partially axially surrounds the single turn inductor 68, and includes a first terminal 86*a*, as well as a second terminal 86*b* that corresponds to, is integral with, or is otherwise connected to the detect port 19 (P4). The first transmission line 80 and the second transmission line 82 are understood to have a similar shape as the single turn inductor 68 it outlines, e.g., a partial octagonal configuration with multiple straight segments that are angled relative to each other. The second terminals 84*b*, 86*b*, are understood to be positioned at the opposite end of the octagonal shape relative to the first and second terminals 70*a*, 70*b* of the single turn inductor 68. The transmission lines 80 and 82 are interconnected by a metal trace 74 which is understood to be placed at a layer different from layer 72.

According to the second embodiment of the directional coupler 10*b*, various dimensions are also contemplated. By way of example only and not of limitation, the width of the first and second transmission lines 80, 82 may be approximately 3 μm. A lateral/co-planar distance or separation between the first and second transmission lines 80, 82 and the single turn inductor 68 may be approximately 3 μm. Furthermore, the value of the capacitor 90 is approximately 800 fF.

Figure 19:
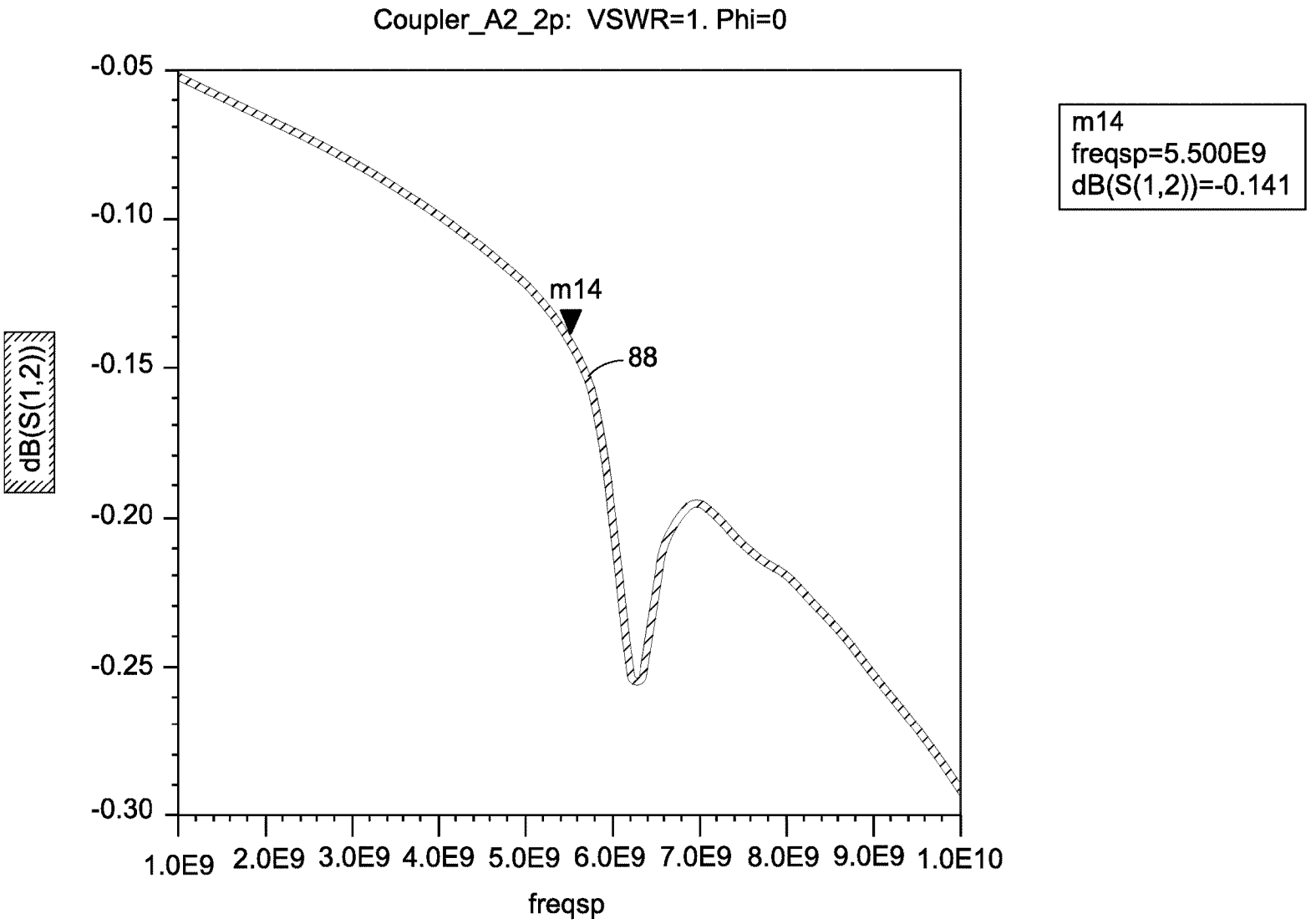
FIG. 19 is a graph showing the insertion loss of the second embodiment of the directional coupler shown in FIG. 18 over an operating frequency range.

The performance of the second embodiment of the directional coupler 10*b* will be described in relation to the graphs of FIGS. 19, 20, 21A, 21B, and 22. The graphs similarly plot various S-parameters of a simulation of the second embodiment of the directional coupler 10*b* in the same manner as above in relation to FIGS. 14, 15, 16A, 16B, and 17 for the second embodiment of the directional coupler 10*b*, FIGS. 8 9, 10A, 10B, and 11 for the first variant of the first embodiment of the directional coupler 10*a*-1 as well as FIGS. 2, 3, 4A, 4B and 5 for the first embodiment of the directional coupler 10*a*. Compared to the other embodiments and variants of the directional couplers discussed before, the insertion loss of the second embodiment of the directional coupler 10*b* is increased, though this insertion loss is already present in the aforementioned harmonics rejection network, and not an additional loss due to coupler implementation. FIG. 19 shows a plot 88 of the insertion loss over a sweep of signal frequency, and at 5.5 GHz, insertion loss is understood to be 0.141 dB, which is understood to be higher than the insertion loss of 0.020 dB for the first embodiment of the directional coupler 10*b* and of 0.030 dB for the second embodiment of the directional coupler 10*c*. In addition, the insertion loss of the second embodiment of the directional coupler 10*b* increases as a frequency increases to around 6.2 GHz. After the frequency is over 6.2 GHz, insertion loss starts to decrease again. Then, the insertion loss increases again when the frequency is over 7 GHz. This is understood to be attributable to parasitic coupling of the entire structure. Nevertheless, these fluctuations in insertion loss over the illustrated frequency range is still near zero, and sufficiently low for the applications contemplated.

Figure 20:
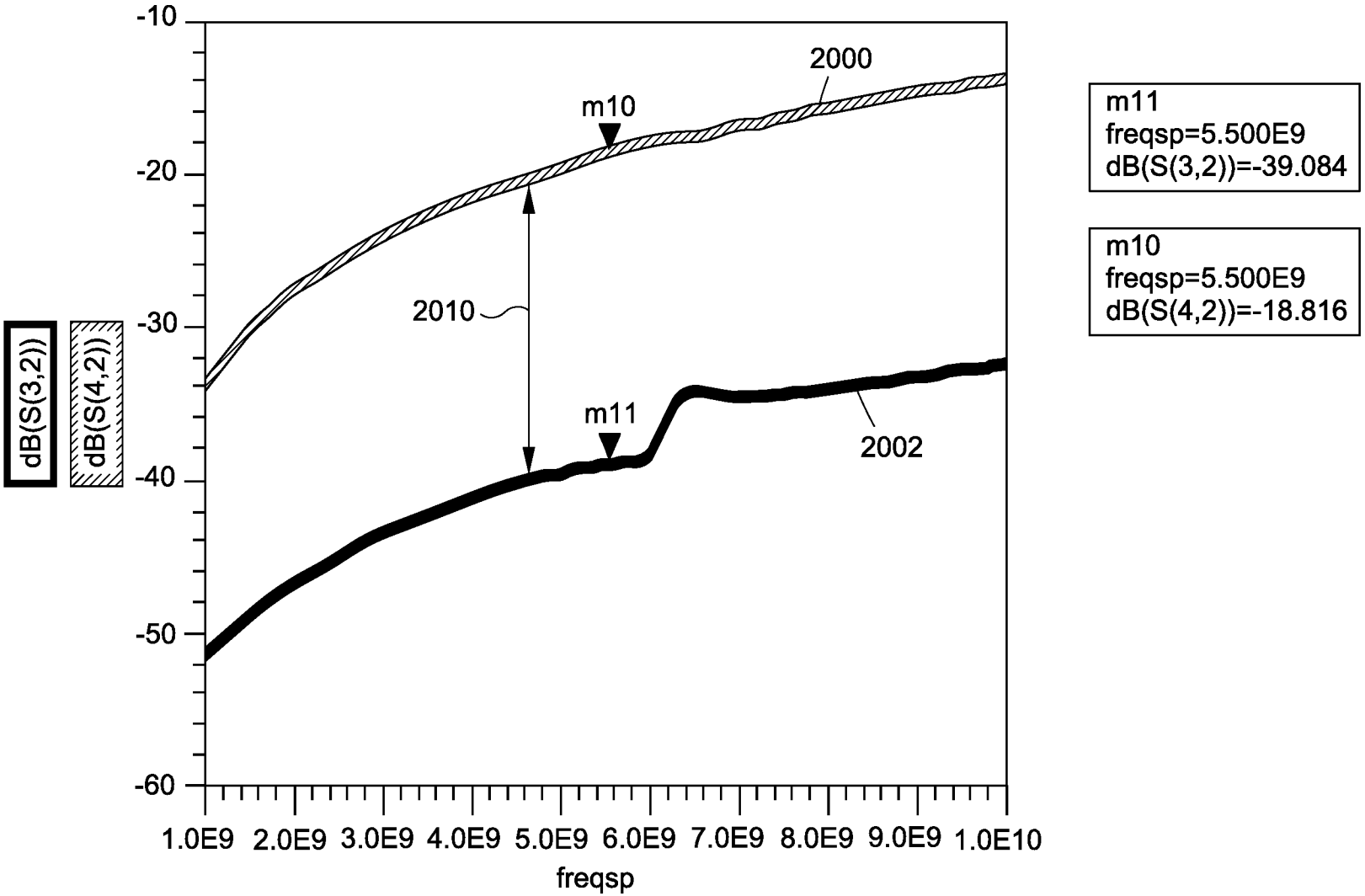
FIG. 20 is a graph showing the S-parameters of the second embodiment of the directional coupler shown in FIG. 18 over an operating frequency range, with the coupling factor, isolation factor, and resultant directivity being detailed.

The graph of FIG. 20 includes a plot 2000 of the coupling factor over a range of frequencies in the second embodiment of the directional coupler 10*b*, along with a plot 2002 of the isolation over the same frequency range. The difference at any particular frequency between the coupling factor/plot 2000 and the isolation/plot 2002 is understood to represent the directivity 2010. As illustrated, the coupling factor of the second embodiment of the directional coupler 10*b* is higher than the coupling factor of all previously considered embodiments because of the increased coupling area. For example, the coupling factor of the second embodiment of the directional coupler 10*b* is −18.816 dB at 5.5 GHz. In comparison, at the same frequency, the coupling factor of the second embodiment of the directional coupler 10*b* is −29.849 dB and the coupling factor of the first embodiment of the directional couplers 10*a* and 10*a*-1 is −34.671 dB. The directivity of the second embodiment of the directional coupler 10*b* is further decreased, though still around 18 dB. It is understood that this level of directivity is suitable for wireless communication transceivers.

Figure 21A:
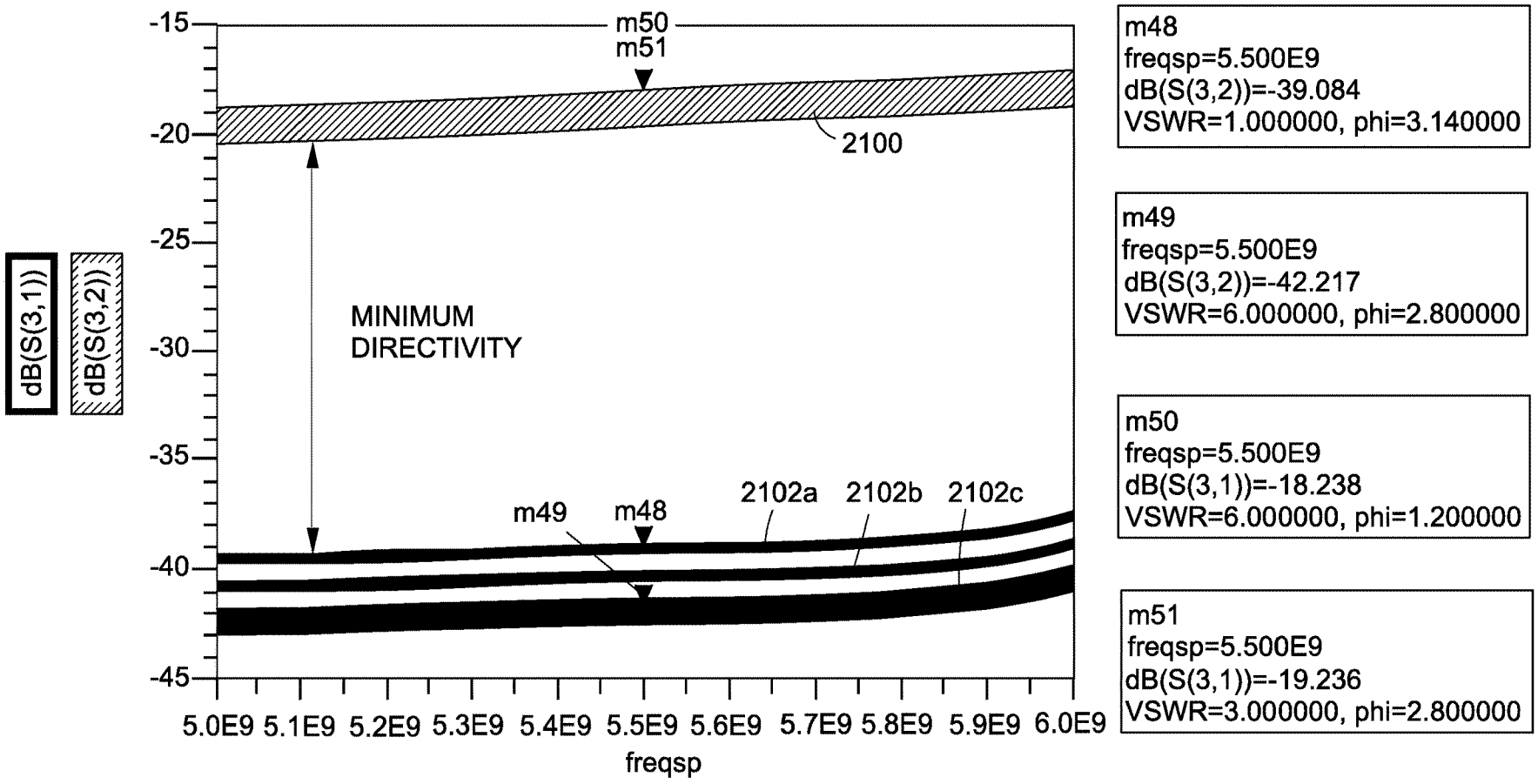
FIG. 21A is a graph showing the S-parameters of the second embodiment of the directional coupler shown in FIG. 18 over different VSWR levels and load phases, with the coupling factor, isolation factor, and minimum directivity being detailed.
Figure 21B:
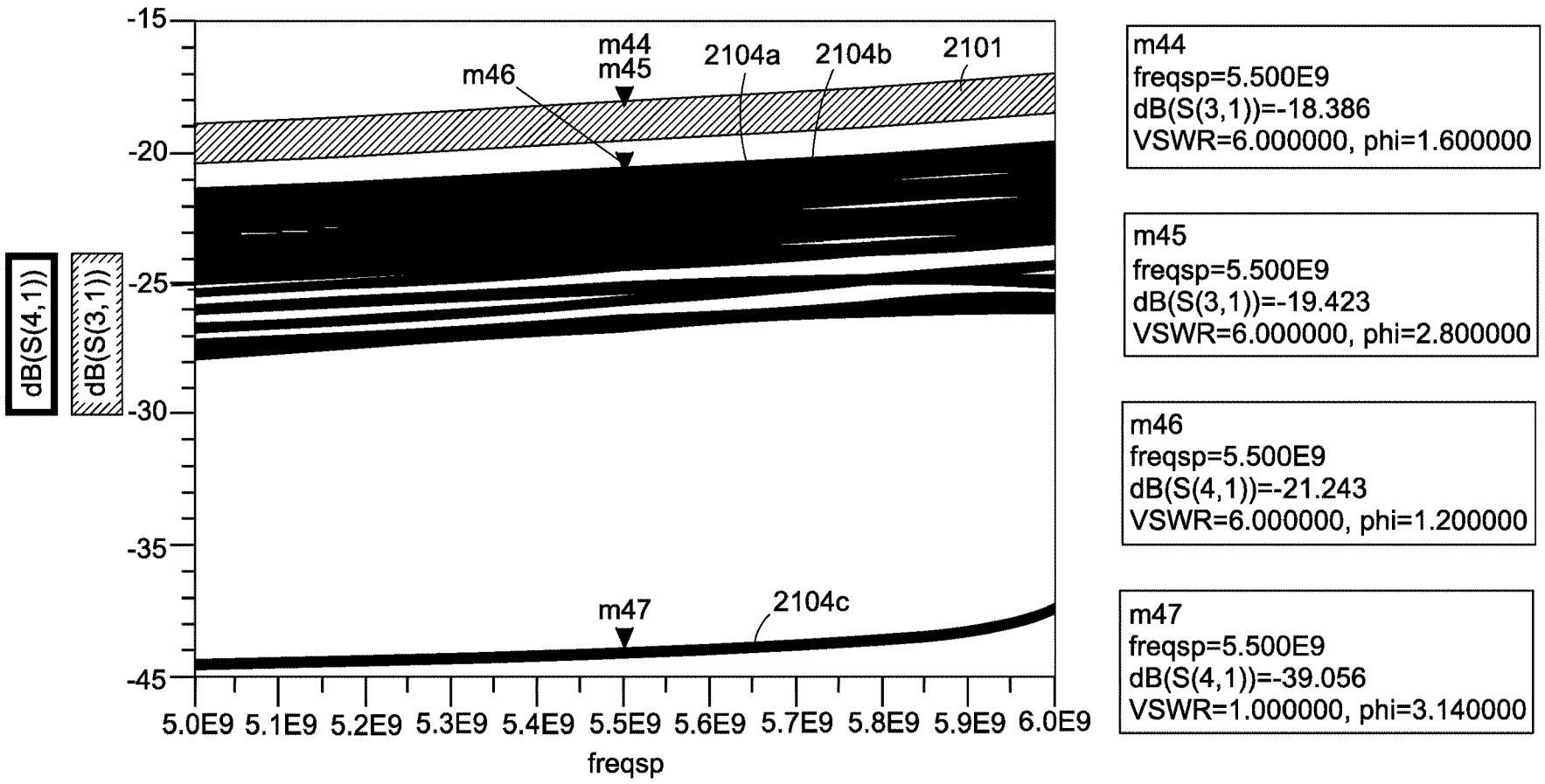
FIG. 21B is a graph showing the S-parameters of the second embodiment of the directional coupler shown in FIG. 18 over different VSWR levels and load phases, with the coupling factor, and isolation factor being detailed.

The graphs of FIGS. 21A, 21B show the simulated S-parameters, and specifically the coupling factor and isolation of the second embodiment of the directional coupler 10*b* over various frequencies, VSWR levels and phase shifts. As can be seen, the coupling factor of the second embodiment of the directional coupler 10*b* is increased over previously considered directional couplers. The coupling factor corresponds to S31 shown plot 2100 in FIG. 21A and plot 2101 in FIG. 21B. The isolation factor S32 is shown as plots 2102*a-c* in FIG. 21A. The other isolation factor S41 is shown as plots 2104*a-c* in FIG. 21B. The minimum directivity over various frequencies, VSWR levels and phase shifts, is shown in FIG. 21A. The minimum directivity of the second embodiment of the directional coupler 10*b* is approximately 18 dB and is suitable for mobile communications.

Figure 22:
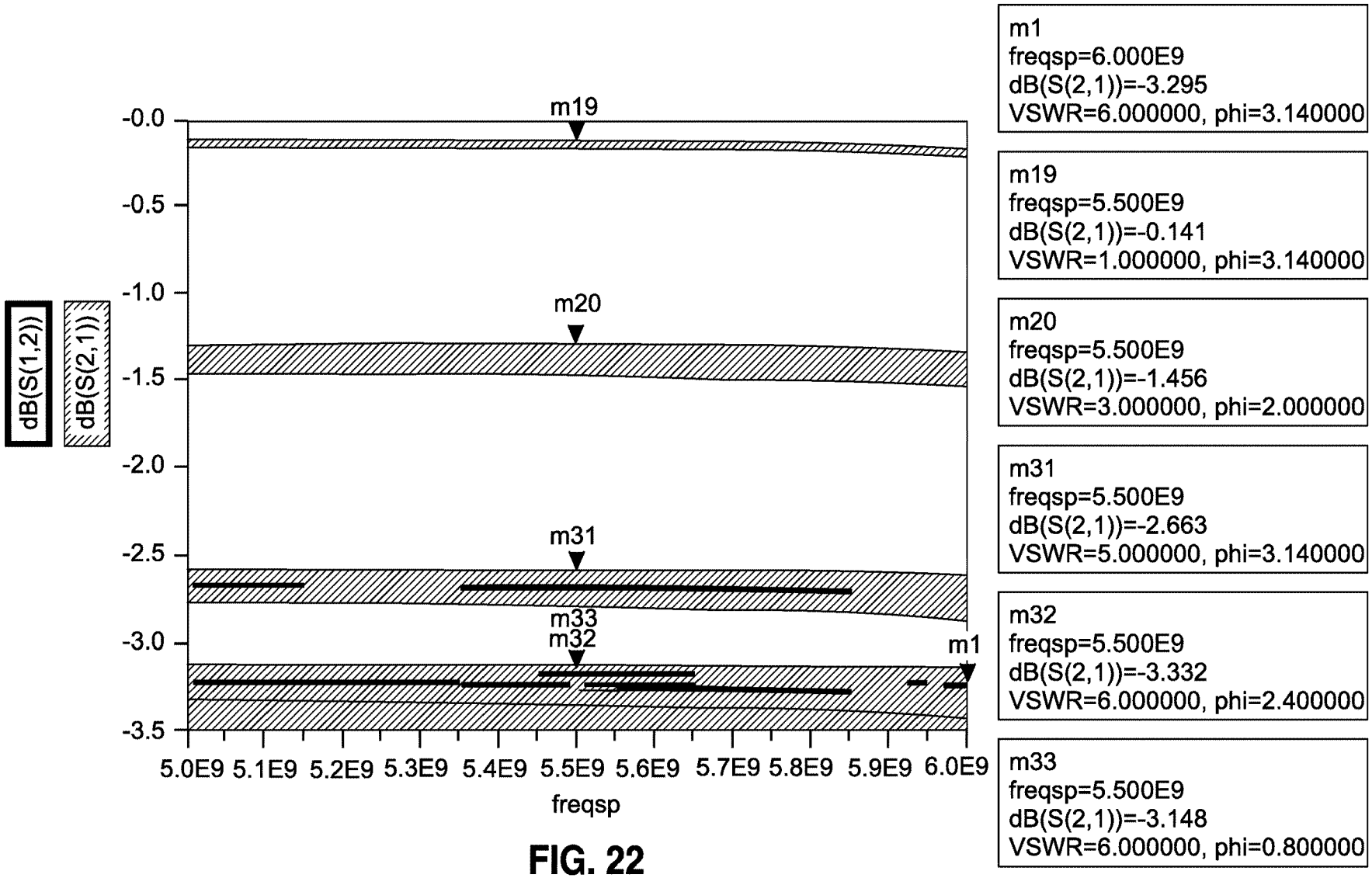
FIG. 22 is a graph showing the S-parameters of the second embodiment of the directional coupler shown in FIG. 18 over different VSWR levels and load phases, with the insertion loss being detailed.

Referring now to FIG. 22, the insertion loss of the second embodiment of the directional coupler 10*b* over various frequencies, VSWR levels and phase shifts is slightly higher than the insertion loss of the directional couplers considered previously. For example, the insertion loss is approximately 3.295 dB at a 6 GHz signal frequency under the condition that VSWR is 6:1 and phase load is 3.14 dB. Under the same frequency and condition, the insertion loss of the other directional couplers is less than or equal to 3.132 dB. Although the performance of the second embodiment of the directional coupler 10*b* is slightly reduced its insertion loss is still close to zero over various frequencies, VSWR levels and phase shifts. These results above are simulated with harmonics blocking capacitor.

FIG. 23 is a top plan view of the second embodiment of the directional coupler 10*b*, but with the addition of a harmonic blocking capacitor 90 as part of the output matching network. In further detail, the harmonic blocking capacitor 90 is connected across the single turn inductor 68. By way of example only and not of limitation, the capacitance of the harmonic blocking capacitor 90 is 800 fF. Other than the position shown in FIG. 23, the interconnect trace 74 may be routed around the single turn inductor 68.

Figure 24:
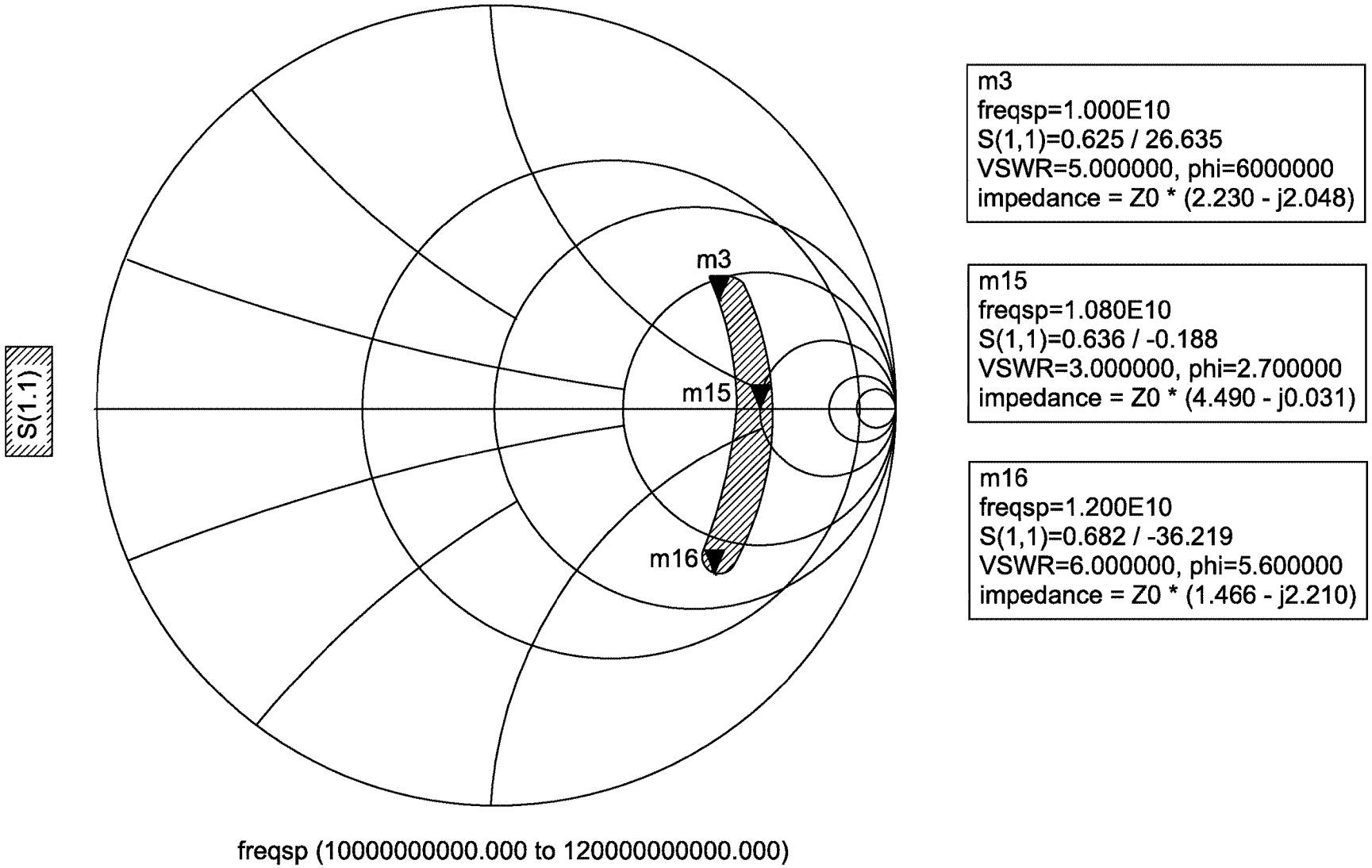
FIG. 24 is a graph showing the input reflection coefficient of the first variant of the second embodiment of the directional coupler shown in FIG. 23 over an operating frequency range.

The Smith chart of FIG. 24, illustrates the performance gains achieved by the addition of the harmonic blocking capacitor 90. S(1,1) refers to the ratio of the signal that reflects from the input port 16 (P1) for a signal incident on the input port 16 (P1). The results show that three reflection coefficients, corresponding to m3, m15, and m16, are all high at second harmonic frequencies over VSWR levels and phase shifts.

Figure 25B:
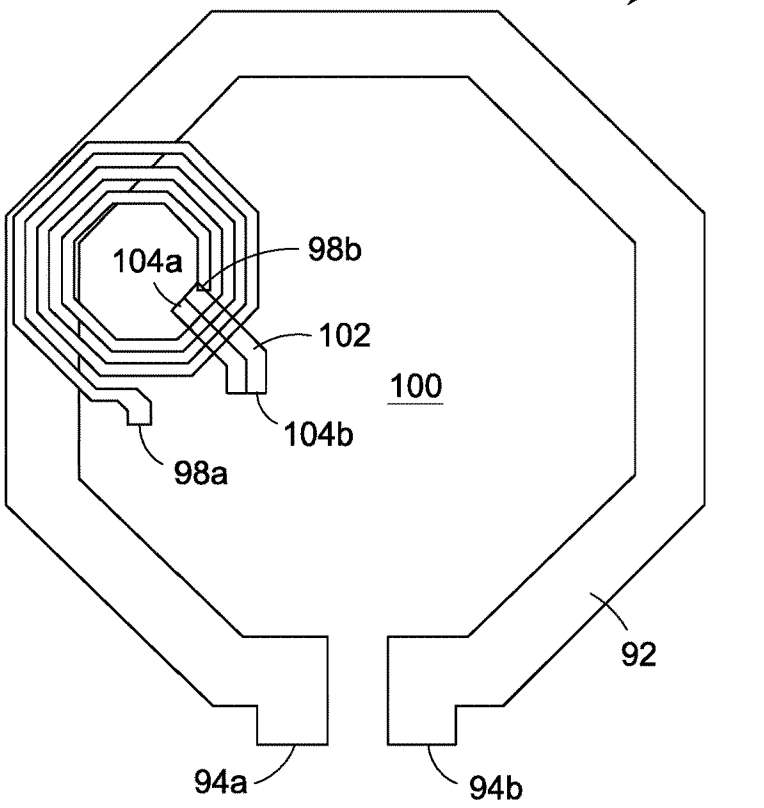
FIG. 25B is a top plan view of the third embodiment of the directional coupler shown in FIG. 25A.
Figure 25A:
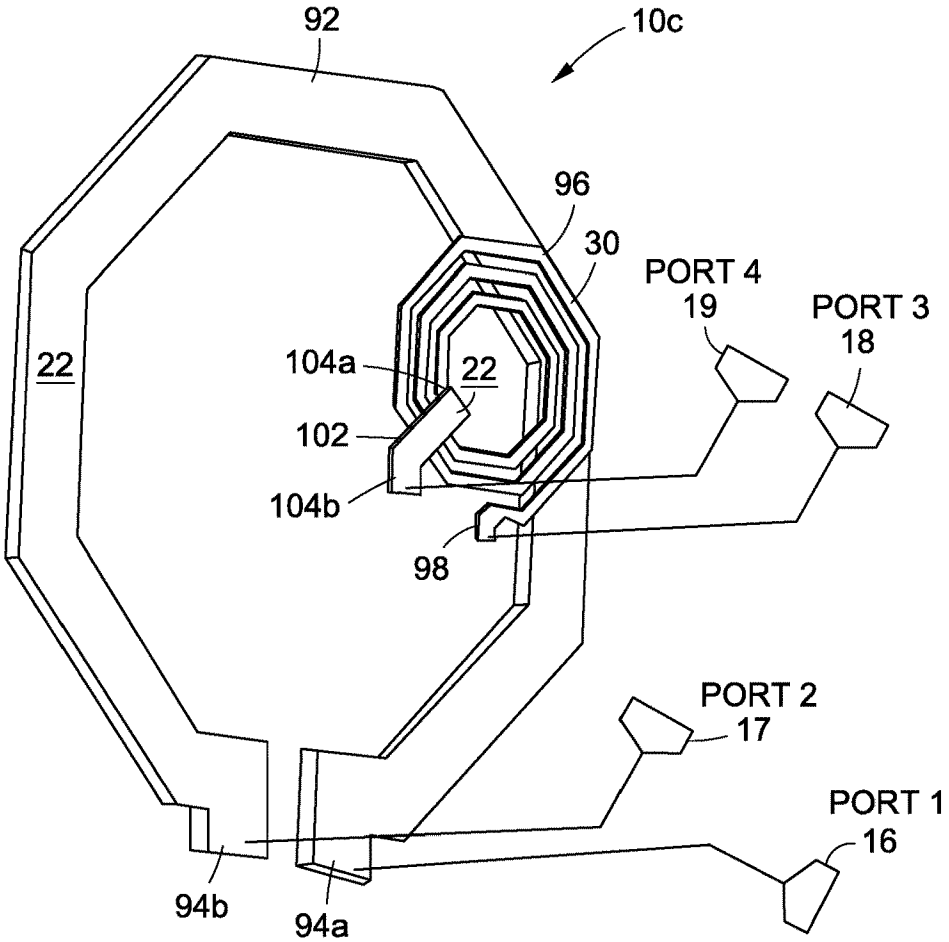
FIG. 25A is a perspective view of a third embodiment of the directional coupler.

An exemplary third embodiment of the directional coupler 10*c* is shown in FIGS. 25A and 25B. Again, similar to the other embodiments of the directional couplers 10 described above, there is an input port 16 (Port P1), an antenna port 17 (Port P2), an isolation port 18 (Port P3), and a detect port 19 (Port P4). The third embodiment of the directional coupler 10*c* is understood to implement the same resonance-based harmonic blocking network described above in relation to FIG. 18 and FIG. 23. Rather than a coupled line extending around the single turn inductor 68, the inductive winding structure may be different, and inserted in the main signal path while maintaining acceptable levels of directivity.

In further detail, there is a single turn inductor 92 with a first terminal 94*a* on a first end thereof that corresponds to, or is otherwise electrically connected to the input port 16. The other, second end of the single turn inductor 92 is a second terminal 94*b* that corresponds to, or is otherwise electrically connected to the antenna port 17. As best illustrated in FIG. 25B, the single turn inductor 92 is defined by a looped, octagonal configuration comprised of multiple segments angled relative to each other. According to one embodiment, the start and end of the loop, e.g., the first and second terminals 94*a*, 94*b*, are on one of the octagonal segments. A gap 95 is defined across the space between the ends of the single turn inductor 92. The single turn inductor 92 may be disposed on the first conductive layer 22. The width of the conductive trace comprising the single turn inductor 92 may likewise be 15 μm, while the thickness of the same may be 4 μm. The overall dimensions of the single turn inductor 92 may be 150 μm×150 μm.

Disposed on a second conductive layer 30 is an inductive winding 96 with at least one turn, though in the illustrated embodiment, there are multiple turns. As indicated above, the first conductive layer 22 is in a substantially co-planar relationship to the second conductive layer 30, and one is offset from the other by a predetermined distance. Thus, the inductive winding 96 overlaps or is overlapped by the single turn inductor 92. In accordance with one embodiment, the intermediate space between the two layers is approximately 0.95 μm. The inductive winding 96 has one end with a first terminal 98*a* that is connected to the isolation port 18, and another end with a second terminal 98*b* within the interior of the spiral of the inductive winding 96. The inductive winding 96 is positioned relative to the single turn inductor 92 such that the inductive winding 96 is at least partially overlapped by the single turn inductor 92, and remains within an axially interior region 100 defined thereby. In an exemplary embodiment, the overall dimensions of the inductive winding 96 are approximately 52 μm×52 μm, while the width of the conductive trace corresponding to the inductive winding 96 is approximately 2.63 μm. The thickness of the conductive trace corresponding to the inductive winding 96 is approximately 0.56 μm. The spacing between turns of the inductive winding 96 may be approximately 2.57 μm.

The third embodiment of the directional coupler 10*c* further includes a signal trace 102 with a first terminal 104*a* and a second terminal 104*b*. The first terminal 104*a* is connected to the second terminal 98*b* of the inductive winding 96, and the second terminal 104*b* is understood to be connected to the detect port 19. According to one embodiment, the signal trace 102 is disposed on the first conductive layer 22, though this is by way of example only and not of limitation.

Figure 26:
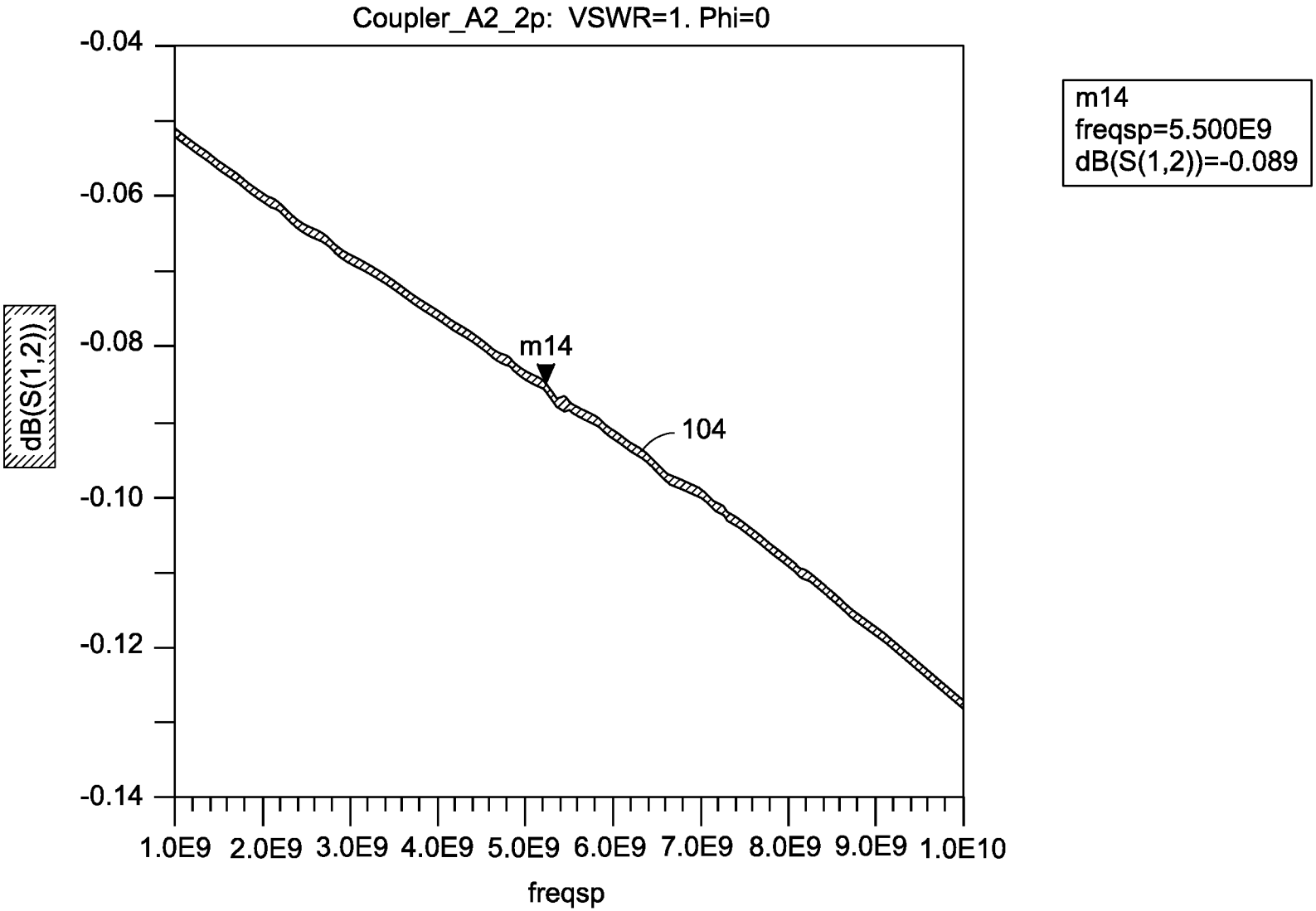
FIG. 26 is a graph showing the insertion loss of the third embodiment of the directional coupler shown in FIGS. 25A and 25B over an operating frequency range.

Referring now to FIGS. 26, 27, 28A, 28B, and 29, the simulated S-parameters of the third embodiment of the directional coupler 10*c* are plotted over a frequency range. These simulation results are of a circuit that incorporates a resonant capacitor connected in parallel with the single turn inductor 68. An exemplary value of the capacitor is 800 fF, as in the previous examples. FIG. 26 shows a plot 104 of the insertion loss over a sweep of signal frequency, which shows that at 5.5 GHz, the insertion loss is 0.089 dB, which is slightly higher than the insertion loss of the first embodiment of the directional coupler 10*a*, and slightly lower than the insertion loss of the second embodiment of the directional coupler 10*b*. It is understood that the increased footprint and the increased coupling area of the inductive winding 96 associated with the third embodiment of the directional coupler 10*c* results in these differences.

Figure 27:
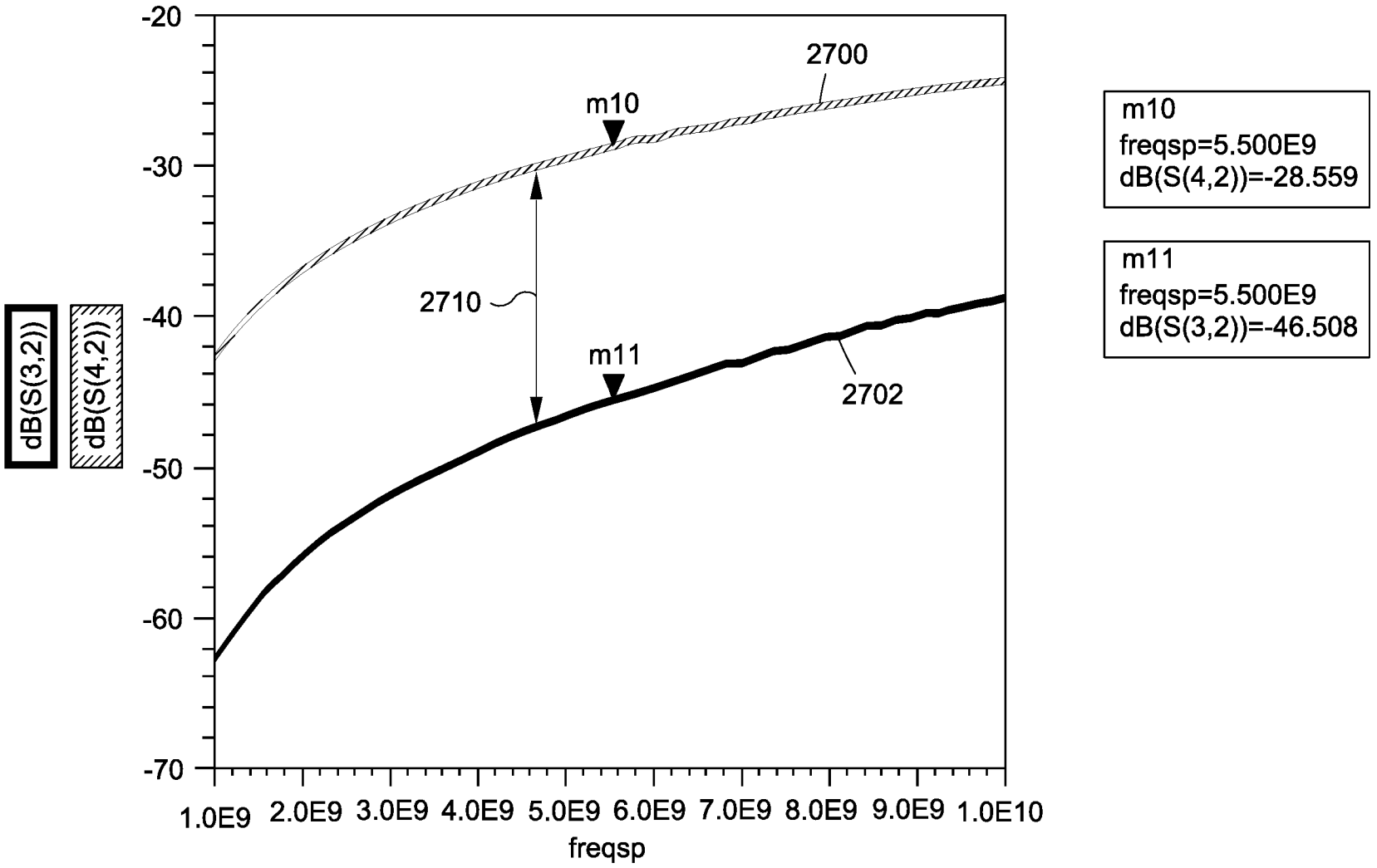
FIG. 27 is a graph showing the S-parameters of the third embodiment of the directional coupler shown in FIGS. 25A and 25B over an operating frequency range, with the coupling factor, isolation factor, and resultant directivity being detailed.

FIG. 27 shows a plot 2700 of the coupling factor over a range of frequencies in the third embodiment of the directional coupler 10*c*, along with a plot 2702 of the isolation over the same frequency range. The directivity 2710 is approximately 18 dB, which, again, is understood to be suitable for mobile communications applications.

Figure 28A:
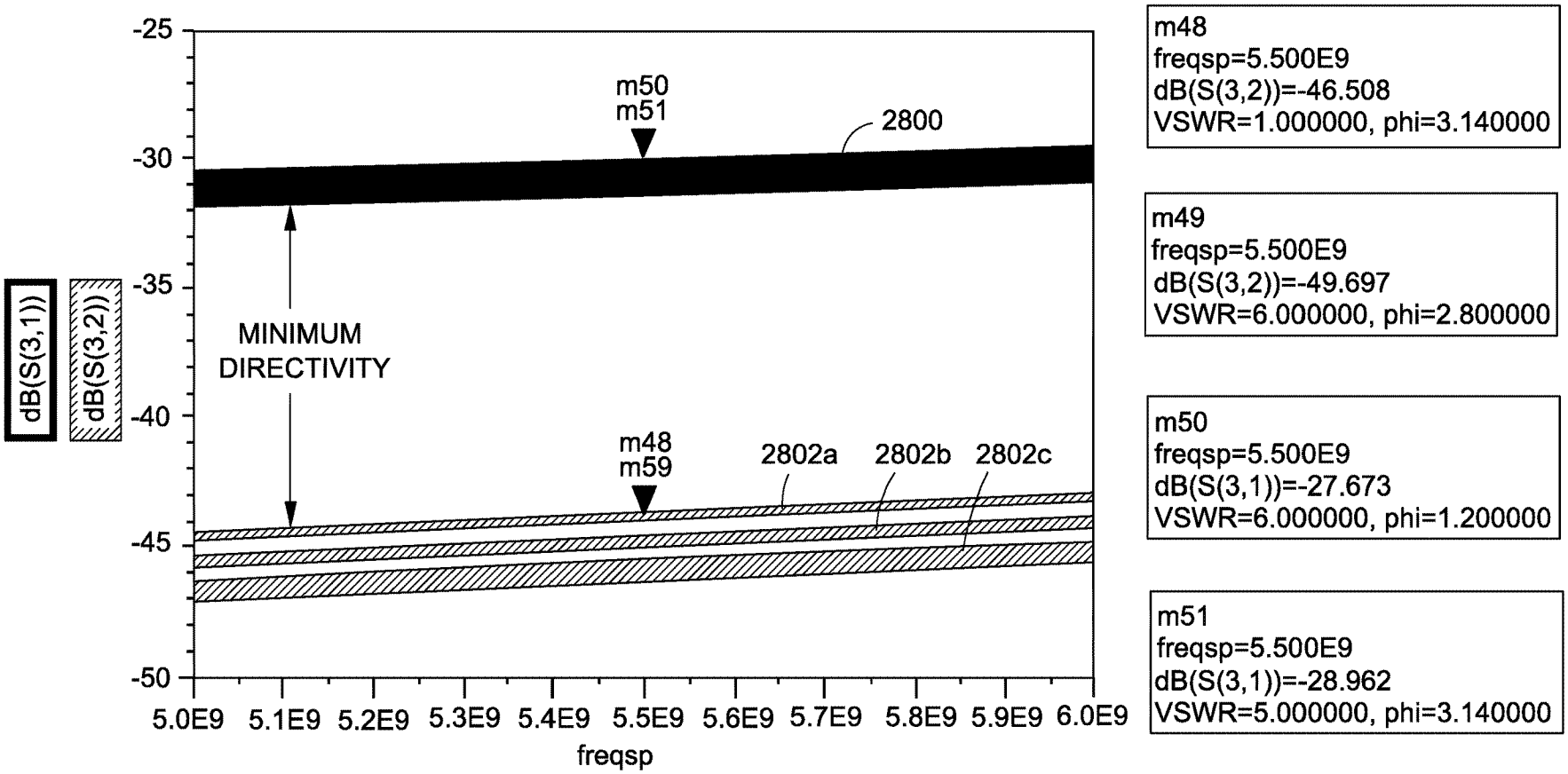
FIG. 28A is a graph showing the S-parameters of the third embodiment of the directional coupler shown in FIGS. 25A and 25B over different VSWR levels and load phases, with the coupling factor, isolation factor, and minimum directivity being detailed.
Figure 28B:
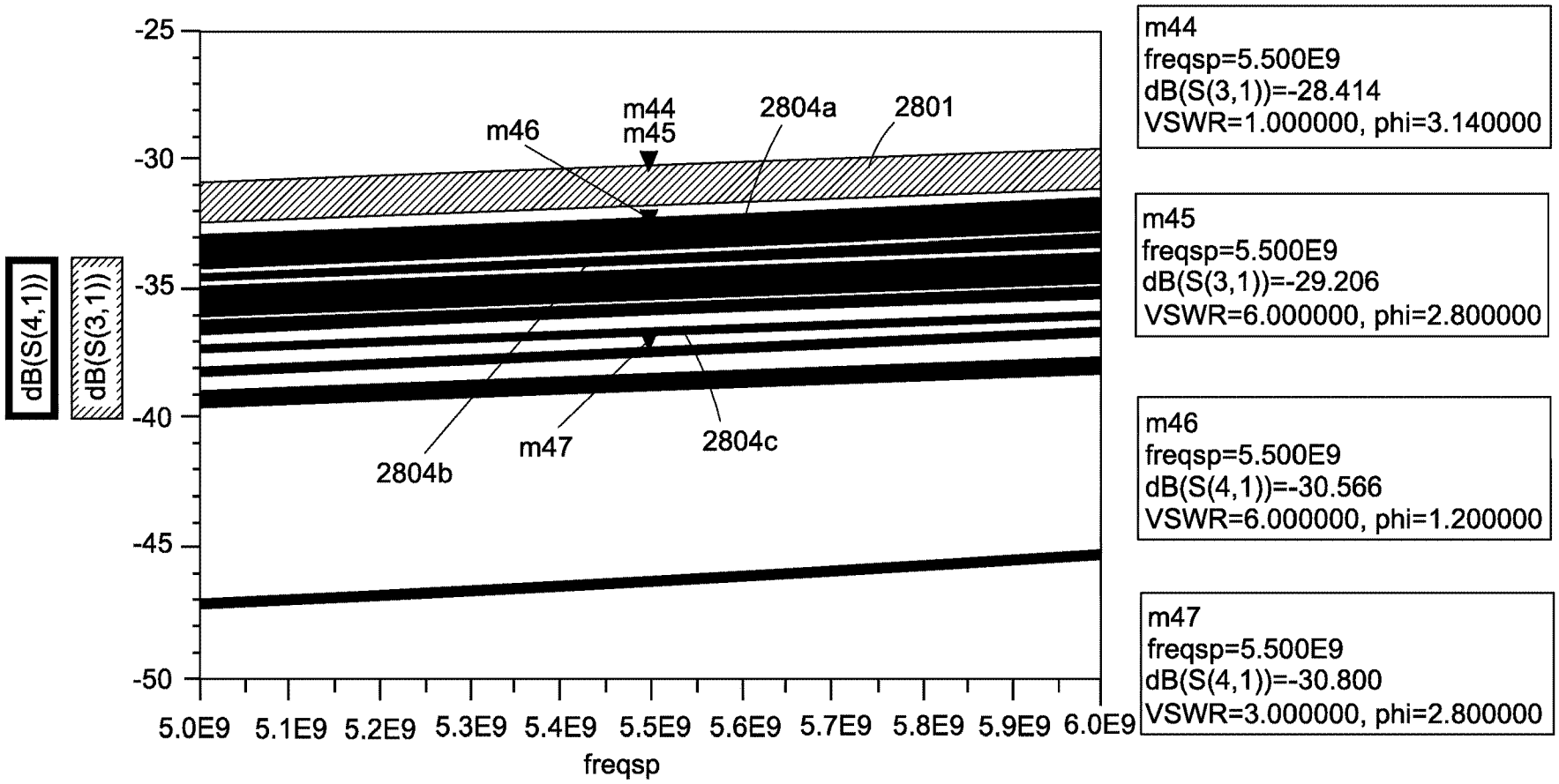
FIG. 28B is a graph showing the S-parameters of the third embodiment of the directional coupler shown in FIGS. 25A-B over different VSWR levels and load phases, with the coupling factor, and isolation factor being detailed.
Figure 29:
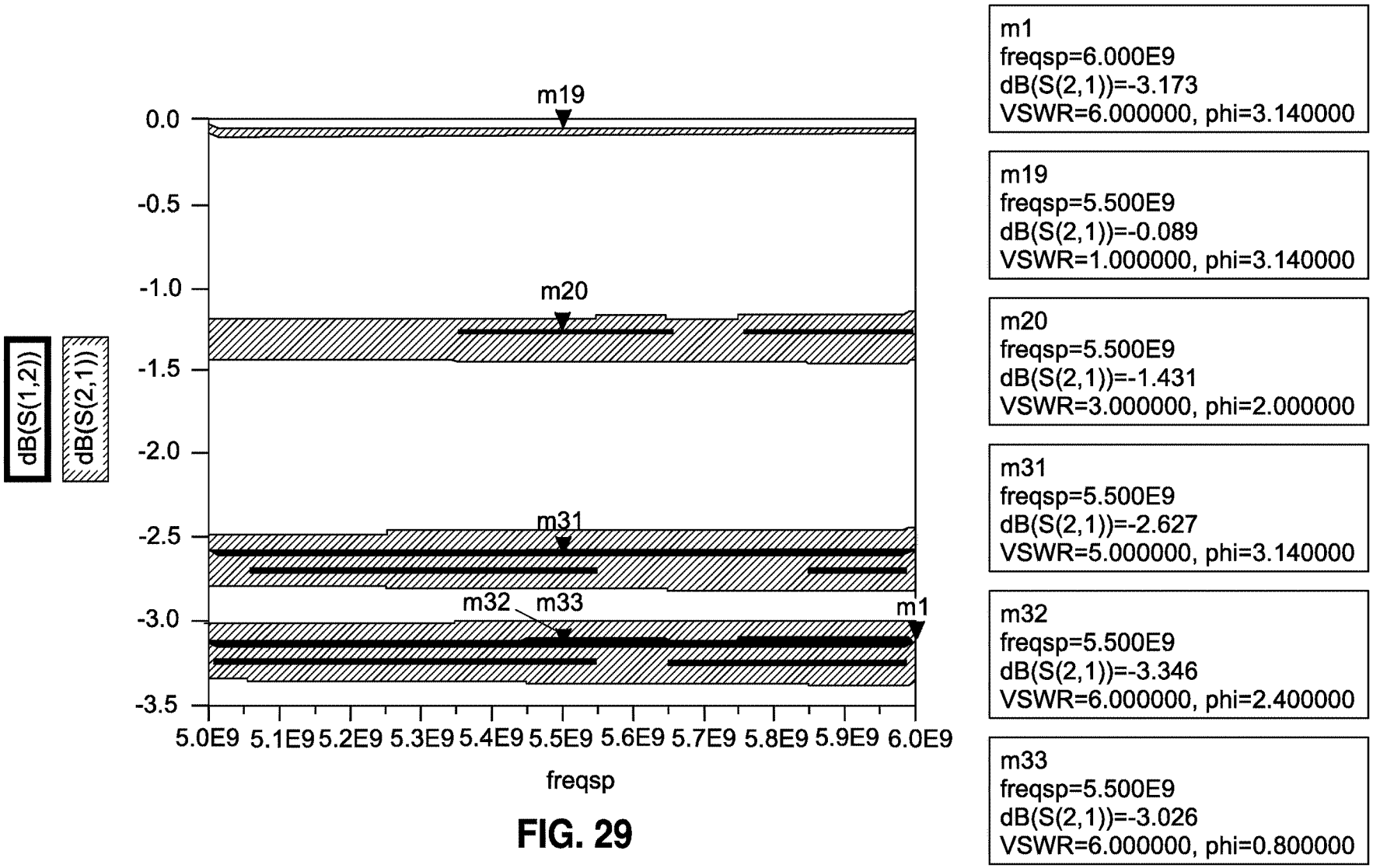
FIG. 29 is a graph showing the S-parameters of the third embodiment of the directional coupler shown in FIGS. 25A-B over different VSWR levels and load phases, with the insertion loss being detailed.

The graphs of FIGS. 28A and 28B illustrate the simulated coupling factor and isolation of the third embodiment of the directional coupler 10*c* over various frequencies, voltage standing wave ratios (VSWR) levels and phase shifts, where coupling factor variation is less than +/−1.0 dB while VSWR at the antenna port is up to 6:1. It can be seen that the coupling factor of the third embodiment of the directional coupler 10*c* is greater than the coupling factor of the other couplers in the first embodiment. The coupling factor corresponds to S31 shown plot 2800 in FIG. 28A and plot 2801 in FIG. 28B. The isolation factor S32 is shown as plots 2802*a-c* in FIG. 28A. The other isolation factor S41 is shown as plots 2804*a-c* in FIG. 28B. The minimum directivity shown in FIG. 28A is around 18 dB, which is understood to be suitable for mobile applications. The graph of FIG. 29 shows that the insertion loss of the third embodiment of the directional coupler 10*c* is slightly less than the insertion loss of the first embodiment of the directional couplers. It is further illustrated that insertion loss is near zero, as contemplated in accordance with various embodiments of the present disclosure.

Figure 30B:
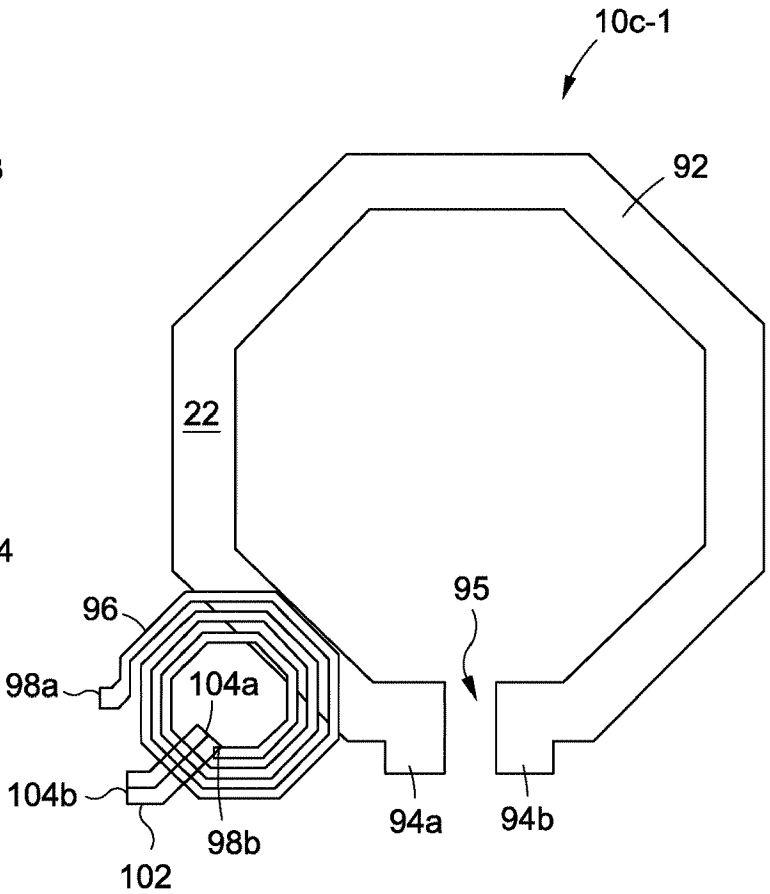
FIG. 30B is a top plan view of the first variation of the third embodiment of the directional coupler shown in FIG. 30A.
Figure 30A:
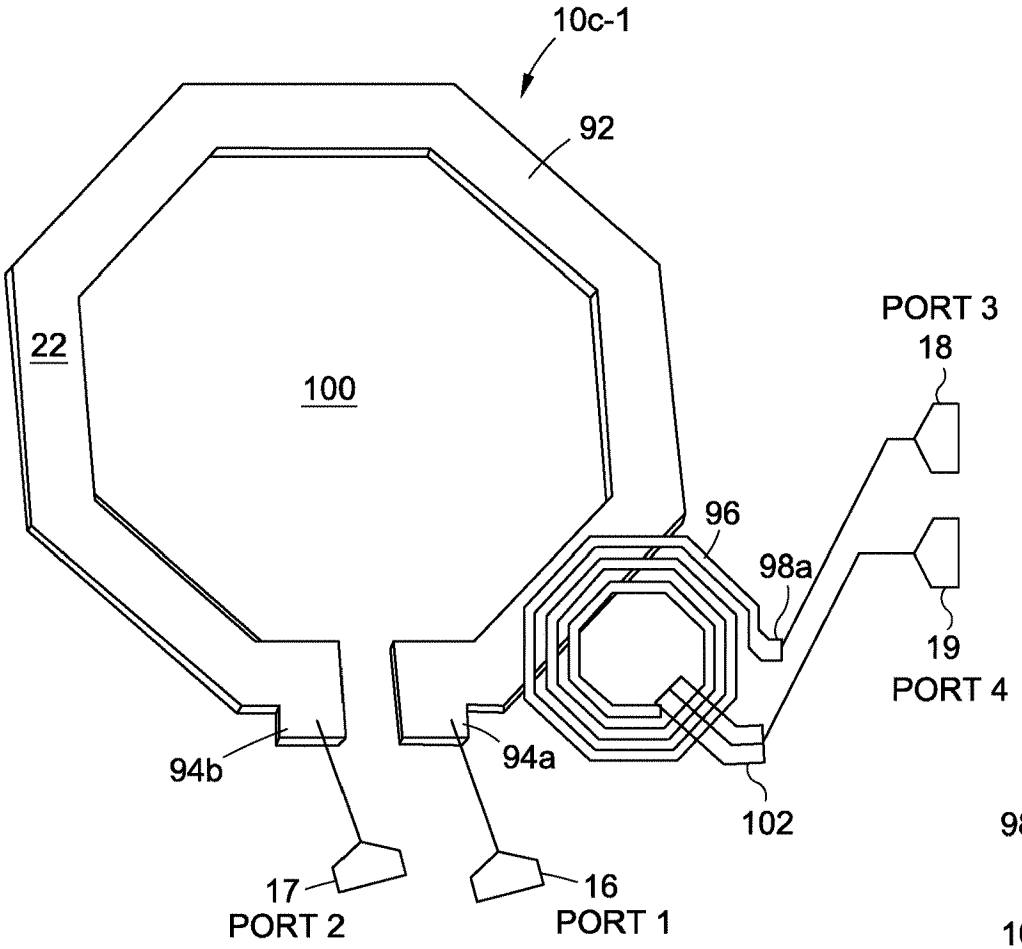
FIG. 30A is a perspective view of a first variation of the third embodiment of the directional coupler.

Referring now to FIGS. 30A and 30B, there is depicted a first variant of a third embodiment of the directional coupler 10*c*-1. Like the other embodiments of the directional couplers 10 described above, there is an input port 16 (Port P1), an antenna port 17 (Port P2), an isolation port 18 (Port P3), and a detect port 19 (Port P4). The first variant of the third embodiment of the directional coupler 10*c*-1 is similar in many respects to the third embodiment of the directional coupler 10*c*. One similarity is the same single turn inductor 92 with the first terminal 94*a* that is connected to the input port 16, and the second terminal 94*b* that is connected to the antenna port 17. The single turn inductor 92 is defined by a looped, octagonal configuration comprised of multiple segments angled relative to each other, and the start and end of the loop, e.g., the first and second terminals 94*a*, 94*b*, are on one of the octagonal segments. A gap 95 is defined across the space between the ends of the single turn inductor 92. The single turn inductor 92 may be disposed on the first conductive layer 22.

Another similarity to the third embodiment of the directional coupler 10*c* is the inductive winding 96 that is disposed on the second conductive layer 30. The inductive winding 96 can have multiple turns with at least one turn, though in the illustrated embodiment, there are multiple turns. Again, with the first conductive layer 22 being in a substantially co-planar relationship to the second conductive layer 30, one is offset from the other by a predetermined distance, and the inductive winding 96 overlaps or is overlapped by the single turn inductor 92. The inductive winding 96 has one end with a first terminal 98*a* that is connected to the isolation port 18, and another end with a second terminal 98*b* within the interior of the spiral of the inductive winding 96. Unlike the third embodiment of the directional coupler 10*c*, the inductive winding 96 of the first variant of the third embodiment of the directional coupler 10*c*-1 is positioned relative to the single turn inductor 92 such that the inductive winding 96 is at least partially overlapped by the single turn inductor 92, and remains outside an axially interior region 100 defined thereby. In other words, the inductive winding 96 is placed outside of the main signal inductor (single turn inductor 92).

Additionally, there is a signal trace 102 with the first terminal 104*a* and a second terminal 104*b*. The first terminal 104*a* is connected to the second terminal 98*b* of the inductive winding 96, and the second terminal 104*b* is understood to be connected to the detect port 19. According to one embodiment, the signal trace 102 is disposed on the first conductive layer 22, though this is by way of example only and not of limitation.

Figure 31:
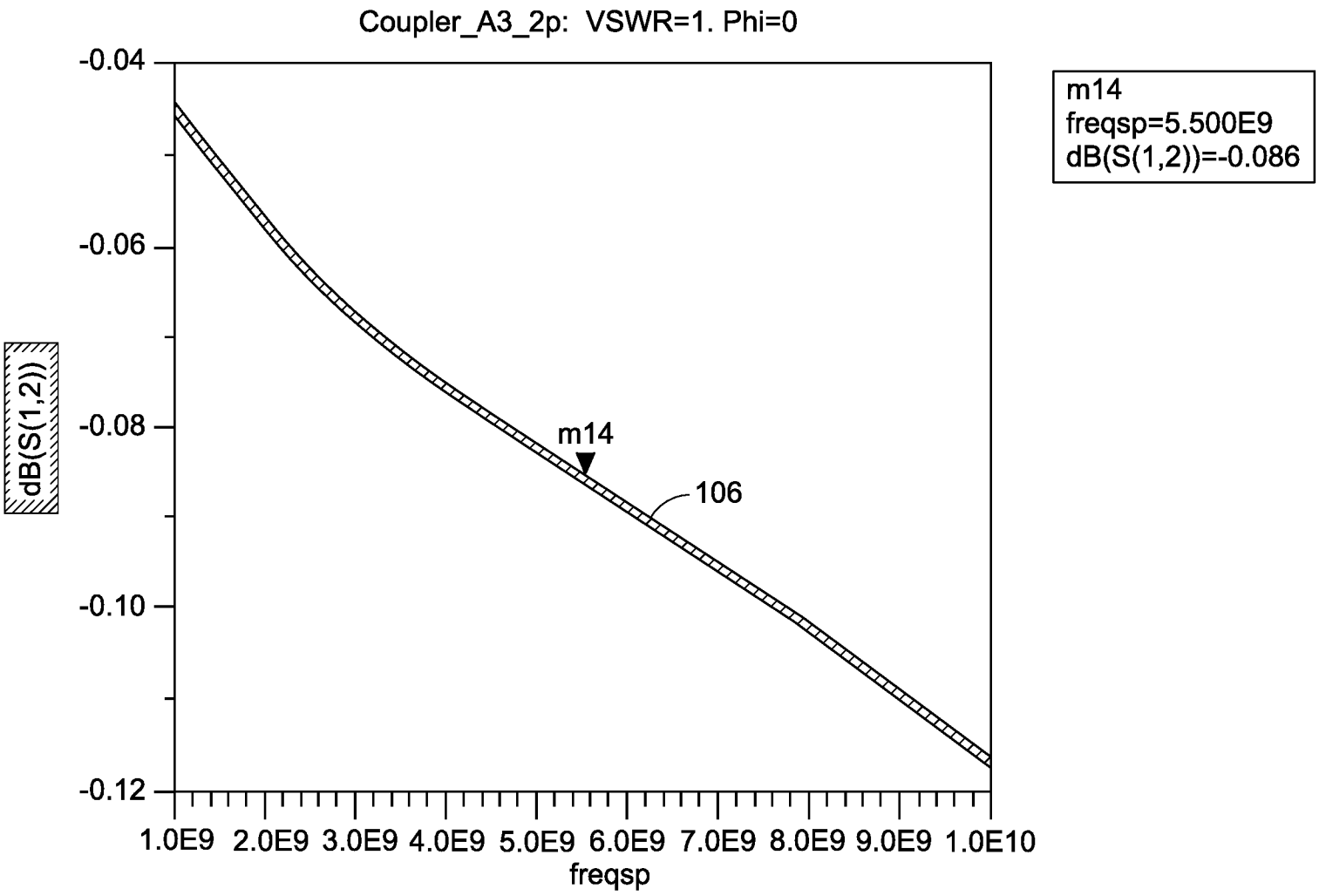
FIG. 31 is a graph showing the insertion loss of the first variation of the third embodiment of the directional coupler shown in FIGS. 30A-B over an operating frequency range.
Figure 32:
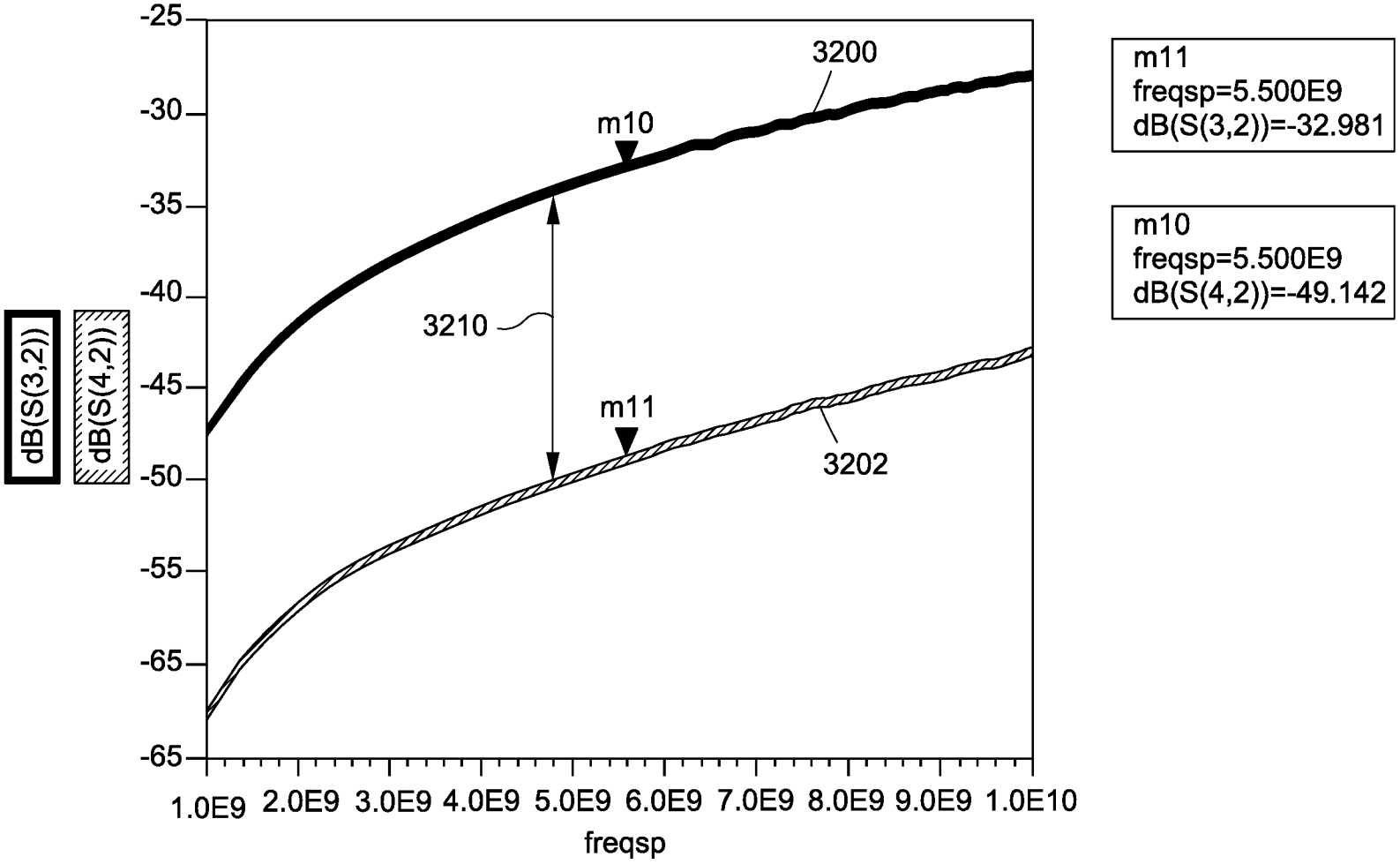
FIG. 32 is a graph showing the S-parameters of the first variation of the third embodiment of the directional coupler shown in FIGS. 30A-B over an operating frequency range, with the coupling factor, isolation factor, and resultant directivity being detailed.

FIGS. 31, 32, 33A, 33B, and 34 plot the simulated S-parameters of the first variant of the third embodiment of the directional coupler 10*c*-1 over a frequency range. These results are based off of circuit simulations that include a harmonic blocking capacitor, though it is not depicted in FIGS. 30A and 30B. FIG. 31 shows a plot 106 of the insertion loss over a sweep of signal frequency, which shows that at 5.5 GHz, the insertion loss is 0.086 dB, and is substantially the same as the insertion loss for the third embodiment of the directional coupler 10*c*. FIG. 32 shows a plot 3200 of the coupling factor over a range of frequencies in the first variant of the third embodiment of the directional coupler 10*c*-1, along with a plot 3202 of the isolation over the same frequency range. The directivity 3210 is approximately 18 dB. Based upon the similarity with respect to insertion loss and directivity between the third embodiment of the directional coupler 10*c* and the first variant of the third embodiment of the directional coupler 10*c*-1, it is understood that the relative positioning of the inductive winding 96 has no impact on the performance characteristics of the directional coupler 10.

Figure 33A:
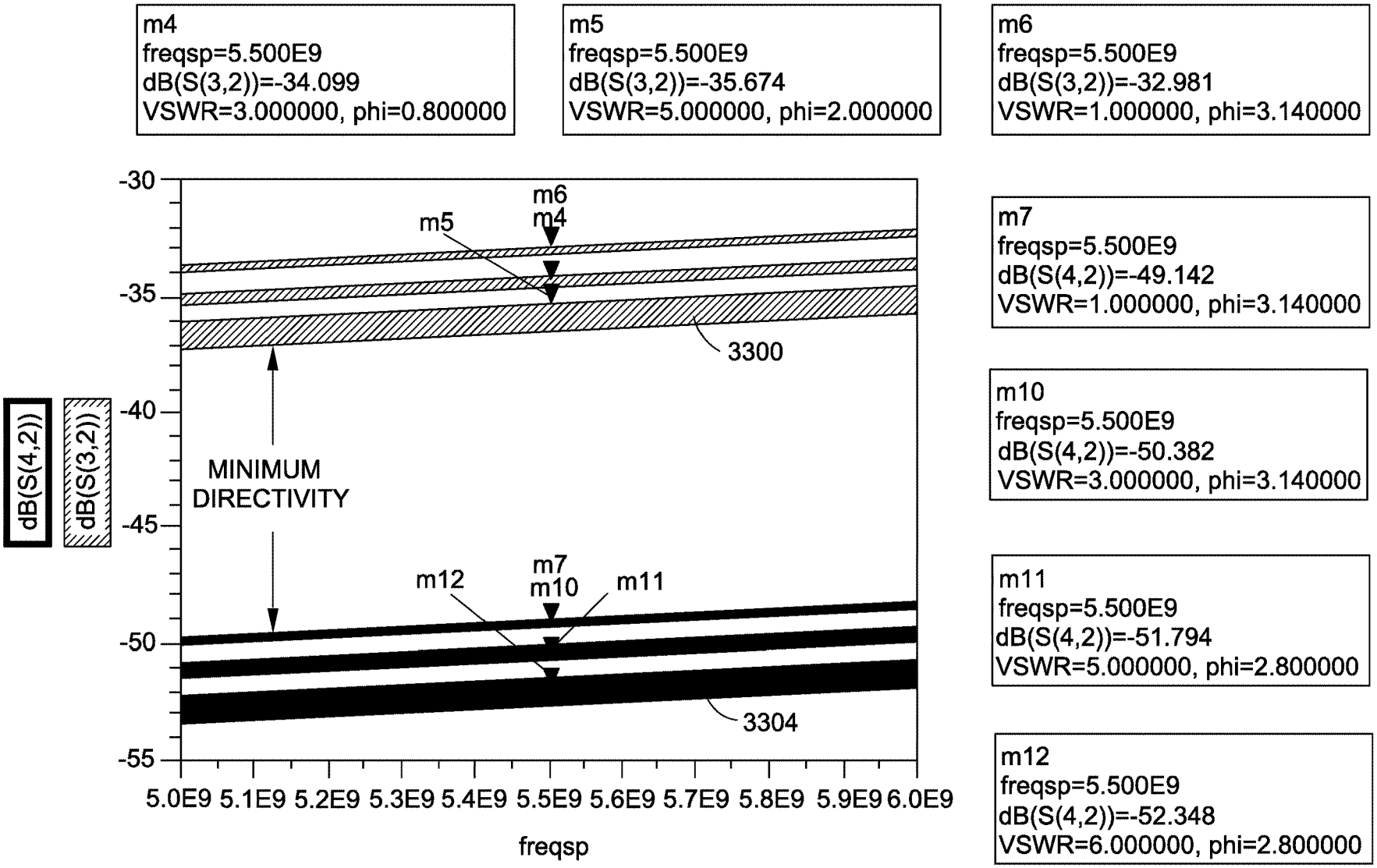
FIG. 33A is a graph showing the S-parameters of the first variation of the third embodiment of the directional coupler shown in FIGS. 30A-B over different VSWR levels and load phases, with the coupling factor, isolation factor, and resultant directivity being detailed.
Figure 33B:
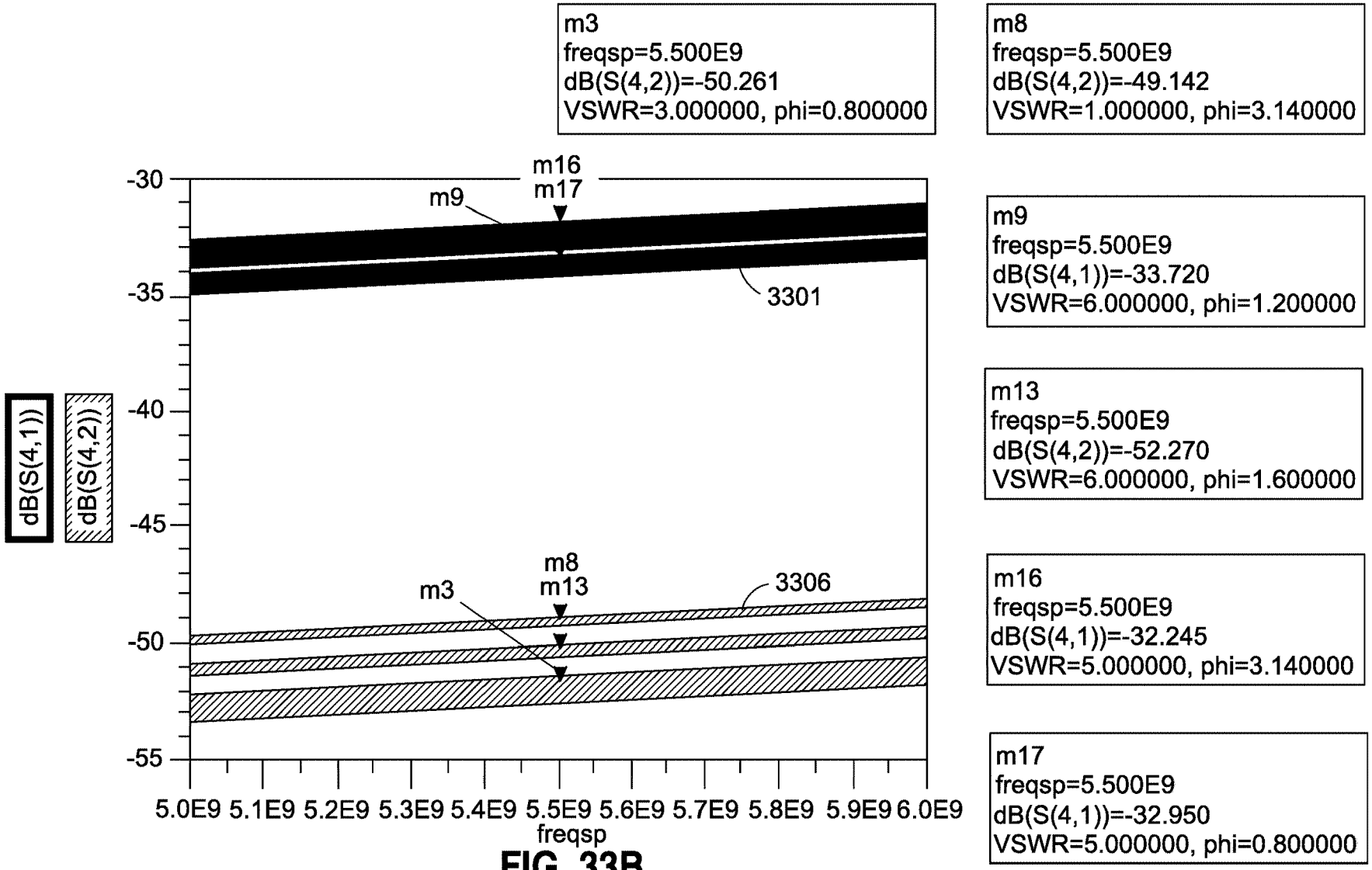
FIG. 33B is a graph showing the S-parameters of the first variation of the third embodiment of the directional coupler shown in FIGS. 30A-B over different VSWR levels and load phases, with the coupling factor, and isolation factor being detailed.

The graphs of FIGS. 33A and 33B illustrate the simulated coupling factor and isolation of the first variant of the third embodiment of the directional coupler 10*c*-1 over various frequencies, voltage standing wave ratios (VSWR) levels and phase shifts, where coupling factor variation is less than +/−1.0 dB while VSWR at the antenna port is up to 6:1. The coupling factor corresponds to S31 shown plot 3300 in FIG. 33A and plot 3301 in FIG. 33B. The isolation factor S32 is shown as plots 3304 in FIG. 33A. The other isolation factor S41 is shown as plots 3306 in FIG. 33B. The minimum directivity shown in FIG. 33A is around 16 dB, which, again, is similar to the operational characteristics of the third embodiment of the directional coupler 10*c*.

The various embodiments of the present disclosed zero insertion loss directional couplers 10 can be inserted into a series chain between a power amplifier output and an antenna for conveying power transfer to load. The coupling feature can be assured by the magnetic and electric fields. The directivity and isolation of the coupler meet requirements of wireless communication transceivers. The detected forward power is constant over wide range of antenna VSWR variations.

The various embodiments of the directional couplers 10*a-e* do not require lengthy transmission lines or inductor windings for power detection while a detect port and an isolation port are physically placed outside of the RF signal chain. The directional couplers 10 need not have a particular shape of a circle, an octagon, or square, unlike inductors. It can be any shape, such as a line, zig-zag, meander line, etc. The proposed structure of the directional couplers 10 does not require top thick metal, and it can be designed into any conductive layer, either below or above the main RF-signal trace, pad, or inductors. Depending on the vertical distance between the coupler and the main trace, the directional coupler 10 may have more or less turns as long as the required coupling factor, directive and isolation factor are satisfied. The proposed coupler has more flexibility as the number of conductive layers increases in advanced nanometer wafer processing technology. More importantly, the proposed coupler does not take any extra space. It can be located under or above either series matching element such as capacitor, inductor, or transformer of the matching network. Unlike conventional directional couplers, the proposed coupler is not required to be at 50-ohm environment. The resulting RF-SoC chip can be as small as a device without the coupler.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention with more particularity than is necessary for the fundamental understanding of the present invention, the description taken with the drawings making apparent to those skilled in the art how the several forms of the present invention may be embodied in practice.

What is claimed is:

1. A directional coupler with a first port, a second port, a third port, and a fourth port, comprising:

a first conductive layer;

a second conductive layer;

a first signal trace on the first conductive layer, the first signal trace being defined by a first signal trace first terminal on the first conductive layer and connected to the first port, and a first signal trace second terminal on the first conductive layer and connected to the second port, the first signal trace being contiguous and on the first conductive layer between the first signal trace first terminal and the first signal trace second terminal;

an inductive winding having multiple turns on the second conductive layer and at least partially overlapping the first signal trace, the inductive winding being defined by an inductive winding second terminal connected to the fourth port and an inductive winding first terminal connected to the third port; and a second signal trace routed away from the first signal trace, the second signal trace including a second signal trace first terminal connected to the fourth port and a second signal trace second terminal connected to the inductive winding second terminal.

2. The directional coupler of claim 1 wherein the first port is an input port, the second port is an antenna port, the third port is an isolation port, and the fourth port is a detect port.

3. The directional coupler of claim 1 wherein a coupling factor between the first signal trace and the inductive winding corresponds to one or more parameters selected from the group consisting of: a number of turns of the inductive winding, an intermediate space distance between the first conductive layer and the second conductive layer, and a size of the overlapped area between the first signal trace and the inductive winding.

4. The directional coupler of claim 1 wherein the first conductive layer and the second conductive layer are in a substantially parallel relationship.

5. The directional coupler of claim 1 wherein the first signal trace comprises a first section with a first predefined width, and a second section with a second predefined width.

6. The directional coupler of claim 5 wherein the first predefined width is larger than the second predefined width.

7. The directional coupler of claim 5 wherein the first section of the first signal trace at least partially overlaps the inductive winding.

8. The directional coupler of claim 5 wherein the first predefined width is substantially equal to the second predefined width.

9. The directional coupler of claim 5 wherein the first signal trace is routed over the inductive winding.

10. The directional coupler of claim 1 wherein second signal trace is disposed on the first conductive layer.

11. The directional coupler of claim 1 wherein the inductive winding has a zig-zag shape.

12. The directional coupler of claim 1 wherein the inductive winding has meandering line shape.

13. A directional coupler with a first port, a second port, a third port, and a fourth port, comprising:

a first conductive layer;

a second conductive layer;

a single-turn inductor on the first conductive layer, the single-turn inductor being defined by a single-turn inductor first terminal connected to the first port, and a single-turn inductor second terminal connected to the second port;

an inductive winding having multiple turns on the second conductive layer and at least partially overlapping the single-turn inductor, the inductive winding being defined by an inductive winding second terminal and an inductive winding first terminal connected to the third port; and a second signal trace routed away from the first signal trace, the second signal trace including a second signal trace first terminal connected to the fourth port and a second signal trace second terminal connected to the inductive winding second terminal.

14. The directional coupler of claim 13 wherein the first port is an input port, the second port is an antenna port, the third port is an isolation port, and the fourth port is a detect port.

15. The directional coupler of claim 13 wherein the first conductive layer and the second conductive layer are in a substantially parallel relationship.

16. The directional coupler of claim 13 wherein the inductive winding on the first conductive layer overlaps a single-turn inductor on the first conductive layer.

17. The directional coupler of claim 13 wherein the inductive winding on the first conductive layer is disposed on an exterior portion of the single-turn inductor on the first conductive layer.

18. A directional coupler with a first port, a second port, a third port, and a fourth port, comprising:

a first conductive layer;

a second conductive layer;

a first signal trace on the first conductive layer, the first signal trace being defined by a first signal trace first terminal on the first conductive layer and connected to the first port, and a first signal trace second terminal on the first conductive layer and connected to the second port, the first signal trace being contiguous and on the first conductive layer between the first signal trace first terminal and the first signal trace second terminal;

an inductive winding having multiple turns on the second conductive layer and at least partially overlapping the first signal trace, the inductive winding being defined by an origin corresponding to the fourth port, and a terminus corresponding to the third port; and a second signal trace routed away from the origin on a layer different from the second conductive layer.

19. The directional coupler of claim 18 wherein the first port is an input port, the second port is an antenna port, the third port is an isolation port, and the fourth port is a detect port.

20. The directional coupler of claim 18 wherein the first conductive layer and the second conductive layer are in a substantially parallel relationship.

* * * * *